US010167717B2

(12) United States Patent
Disko et al.

(10) Patent No.: US 10,167,717 B2
(45) Date of Patent: Jan. 1, 2019

(54) TELEMETRY FOR WIRELESS ELECTRO-ACOUSTICAL TRANSMISSION OF DATA ALONG A WELLBORE

(71) Applicants: Mark M. Disko, Glen Gardner, NJ (US); Timothy I. Morrow, Humble, TX (US); Max Deffenbaugh, Fulshear, TX (US); Katie M. Walker, Milford, NJ (US); Scott W. Clawson, Califon, NJ (US); Henry Alan Wolf, Morris Plains, NJ (US)

(72) Inventors: Mark M. Disko, Glen Gardner, NJ (US); Timothy I. Morrow, Humble, TX (US); Max Deffenbaugh, Fulshear, TX (US); Katie M. Walker, Milford, NJ (US); Scott W. Clawson, Califon, NJ (US); Henry Alan Wolf, Morris Plains, NJ (US)

(73) Assignee: Exxonmobil Upstream Research Company, Spring, TX (US)

( * ) Notice: Subject to any disclaimer, the term of this patent is extended or adjusted under 35 U.S.C. 154(b) by 0 days.

(21) Appl. No.: 16/040,042

(22) Filed: Jul. 19, 2018

(65) Prior Publication Data

US 2018/0320510 A1 Nov. 8, 2018

Related U.S. Application Data

(62) Division of application No. 14/434,734, filed as application No. PCT/US2013/076269 on Dec. 18, 2013.

(Continued)

(51) Int. Cl.
*E21B 47/14* (2006.01)
*E21B 47/16* (2006.01)
(Continued)

(52) U.S. Cl.
CPC ..... *E21B 47/16* (2013.01); *E21B 47/14* (2013.01)

(58) Field of Classification Search
None
See application file for complete search history.

(56) References Cited

U.S. PATENT DOCUMENTS 3,103,643 A * 9/1963 Kalbfell ..... E21B 47/16 367/140
3,512,407 A * 5/1970 Zill ..... E21B 47/00 340/854.9

(Continued)

FOREIGN PATENT DOCUMENTS

EP 0636763 2/1995 ..... E21B 47/12
EP 1409839 4/2005 ..... E21B 43/1185

(Continued)

OTHER PUBLICATIONS

Emerson Process Management (2011) "Roxar Downhole Wireless PT Sensor System," www.roxar.com or www.downhole@roxar.com—2 pages.

(Continued)

*Primary Examiner* — Steven Lim
*Assistant Examiner* — Muhammad Adnan
(74) *Attorney, Agent, or Firm* — ExxonMobil Upstream Research Company Law Department

(57) ABSTRACT

A system for downhole telemetry is provided herein. The system employs a series of communications nodes spaced along a tubular body either above or below ground, such as in a wellbore. The nodes allow for wireless communication between one or more sensors residing at the level of a subsurface formation or along a pipeline, and a receiver at the surface. The communications nodes employ electro-acoustic transducers that provide for node-to-node communication along the tubular body at high data transmission (Continued)

rates. A method of transmitting data in a wellbore is also provided herein. The method uses a plurality of data transmission nodes situated along a tubular body and a specially configured network to accomplish a wireless transmission of data along the wellbore using acoustic energy.

6 Claims, 10 Drawing Sheets

Related U.S. Application Data

(60) Provisional application No. 61/739,414, filed on Dec. 19, 2012.

(51) Int. Cl.

| | |
|---|---|
| ***E21B 43/08*** | (2006.01) |
| ***E21B 44/00*** | (2006.01) |
| ***E21B 47/12*** | (2012.01) |
| ***E21B 47/18*** | (2012.01) |
| ***E21B 43/12*** | (2006.01) |
| ***E21B 47/01*** | (2012.01) |

(56) References Cited

U.S. PATENT DOCUMENTS 3,781,783 A * 12/1973 Tucker ..... G01V 1/44 340/854.1
4,283,780 A * 8/1981 Nardi ..... E21B 47/12 310/322
4,302,826 A * 11/1981 Kent ..... E21B 47/12 175/40
4,314,365 A * 2/1982 Petersen ..... E21B 47/16 175/56
4,884,071 A 11/1989 Howard ..... 340/854
5,128,901 A 7/1992 Drumheller ..... 367/82
5,234,055 A 8/1993 Cornette ..... 166/278
5,373,481 A * 12/1994 Orban ..... E21B 47/16 340/854.4
5,468,025 A * 11/1995 Adinolfe ..... F16L 21/08 285/114
5,480,201 A * 1/1996 Mercer ..... B66C 1/30 294/111
5,495,230 A 2/1996 Lian ..... 340/551
5,562,240 A 10/1996 Campbell ..... 227/130
5,592,438 A 1/1997 Rorden et al. ..... 367/83
5,697,650 A * 12/1997 Brown ..... B05B 15/658 285/197
5,850,369 A 12/1998 Rorden et al. ..... 367/83
5,857,146 A * 1/1999 Kido ..... H04W 52/0229 340/7.38
5,924,499 A * 7/1999 Birchak ..... E21B 47/14 175/40
5,995,449 A * 11/1999 Green ..... E21B 23/04 340/853.3
6,049,508 A 4/2000 Deflandre ..... 367/48
6,125,080 A * 9/2000 Sonnenschein ..... B63C 11/02 367/134
6,177,882 B1 * 1/2001 Ringgenberg ..... E21B 47/122 324/342
6,188,647 B1 * 2/2001 Drumheller ..... B06B 1/0611 29/25.35
6,236,724 B1 * 5/2001 Labaton ..... H04M 1/2155 379/283
6,236,850 B1 * 5/2001 Desai ..... G08C 17/02 455/343.2
6,239,690 B1 * 5/2001 Burbidge ..... H04W 52/0212 340/10.33
6,300,743 B1 * 10/2001 Patino ..... H02J 7/00 320/106
6,305,233 B1 * 10/2001 Braathen ..... G01F 1/667 73/861.27
6,400,646 B1 * 6/2002 Shah ..... E21B 47/16 367/79
6,429,784 B1 * 8/2002 Beique ..... E21B 17/14 166/250.07
6,462,672 B1 10/2002 Besson ..... 340/853.2
6,614,360 B1 * 9/2003 Leggett, III ..... E21B 44/00 340/853.1
6,670,880 B1 12/2003 Hall et al. ..... 336/132
6,695,277 B1 2/2004 Gallis ..... 249/191
6,717,501 B2 4/2004 Hall et al. ..... 336/132
6,727,827 B1 * 4/2004 Edwards ..... E21B 47/122 324/339
6,816,082 B1 11/2004 Laborde ..... 340/853.3
6,868,037 B2 3/2005 Dasgupta et al. ..... 367/54
6,899,178 B2 5/2005 Tubel ..... 166/313
6,912,177 B2 6/2005 Smith ..... 367/82
6,956,791 B2 10/2005 Dopf et al. ..... 367/82
6,980,929 B2 12/2005 Aronstam et al. ..... 702/188
6,987,463 B2 1/2006 Beique et al. ..... 340/856.3
7,006,918 B2 2/2006 Economides et al. ..... 702/1
7,064,676 B2 6/2006 Hall et al. ..... 340/853.1
7,082,993 B2 8/2006 Ayoub et al. ..... 166/250.1
7,140,434 B2 11/2006 Chouzenoux et al. .. 166/250.11
7,224,288 B2 5/2007 Hall et al. ..... 340/853.7
7,249,636 B2 7/2007 Ohmer ..... 166/383
7,257,050 B2 8/2007 Stewart ..... 367/82
7,277,026 B2 10/2007 Hall et al. ..... 340/854.8
RE40,032 E * 1/2008 van Bokhorst ... H04W 52/0216 455/343.2
7,317,990 B2 1/2008 Sinha et al. ..... 702/6
7,321,788 B2 * 1/2008 Addy ..... H04L 7/08 455/574
7,348,893 B2 3/2008 Huang et al. ..... 340/854.3
7,411,517 B2 8/2008 Flanagan ..... 340/854.4
7,477,160 B2 1/2009 Lemenager et al. ..... 340/853.1
7,516,792 B2 4/2009 Lonnes et al. ..... 166/308.1
7,595,737 B2 9/2009 Fink et al. ..... 340/854.4
7,602,668 B2 10/2009 Liang et al. ..... 367/25
7,649,473 B2 1/2010 Johnson et al. ..... 340/853.1
7,775,279 B2 8/2010 Marya et al. ..... 166/297
7,994,932 B2 * 8/2011 Huang ..... E21B 47/182 340/853.4
8,044,821 B2 10/2011 Mehta ..... 340/855.7
8,049,506 B2 11/2011 Lazarev ..... 324/333
8,115,651 B2 2/2012 Camwell et al. ..... 340/853.2
8,162,050 B2 4/2012 Roddy et al. ..... 166/253.1
8,220,542 B2 7/2012 Whitsitt et al. ..... 166/278
8,237,585 B2 8/2012 Zimmerman ..... 340/854.6
8,242,928 B2 8/2012 Prammer ..... 340/853.7
8,330,617 B2 12/2012 Chen et al. ..... 340/854.6
8,347,982 B2 1/2013 Hannegan et al. ..... 175/5
8,434,354 B2 5/2013 Crow et al. ..... 73/152.04
8,496,055 B2 7/2013 Mootoo et al. ..... 166/278
8,539,890 B2 9/2013 Tripp et al. ..... 109/25
8,544,564 B2 10/2013 Moore et al. ..... 175/50
8,787,840 B2 * 7/2014 Srinivasan ..... H04W 52/0245 455/69
8,826,980 B2 9/2014 Neer ..... 166/255.1
8,833,469 B2 9/2014 Purkis ..... 166/373
2002/0026958 A1 3/2002 Brisco ..... 137/268
2002/0043369 A1 * 4/2002 Vinegar ..... E21B 17/003 166/250.07
2002/0153996 A1 * 10/2002 Chan ..... G01S 5/0009 340/10.4
2003/0029241 A1 * 2/2003 Mandel ..... E21B 49/003 73/586
2003/0056953 A1 3/2003 Tumlin et al. ..... 166/298
2003/0117896 A1 * 6/2003 Sakuma ..... H04B 11/00 367/81
2003/0151977 A1 * 8/2003 Shah ..... E21B 47/122 367/82
2004/0026076 A1 * 2/2004 Goodwin ..... E21B 34/08 166/66.6
2004/0065443 A1 4/2004 Berg et al. ..... 166/380
2004/0073370 A1 4/2004 Dasgupta et al. ..... 702/6
2004/0084190 A1 5/2004 Hill et al. ..... 166/386
2004/0105342 A1 6/2004 Gardner et al. ..... 367/25

(56) References Cited

U.S. PATENT DOCUMENTS

2004/0124994 A1* 7/2004 Oppelt ..... E21B 47/12 340/853.1
2004/0256113 A1 12/2004 LoGiudice et al. ..... 166/381
2004/0262008 A1* 12/2004 Deans ..... E21B 41/0007 166/339
2005/0024231 A1 2/2005 Fincher et al. ..... 40/854.4
2005/0039912 A1 2/2005 Hall et al. ..... 166/242.6
2005/0145010 A1 7/2005 Vanderveen et al. ..... 73/1.57
2005/0284659 A1 12/2005 Hall et al. ..... 175/27
2006/0002232 A1 1/2006 Shah et al. ..... 367/82
2006/0085552 A1* 4/2006 Sollenberger ..... H04W 52/0216 709/232
2006/0115095 A1* 6/2006 Giesbrecht ..... H04M 9/08 381/66
2006/0124310 A1 6/2006 Lopez de Cardenas et al. ..... 166/313
2006/0133203 A1 6/2006 James et al. ..... 367/27
2007/0024464 A1 2/2007 Lemenager et al. ..... 340/853.1
2007/0029112 A1 2/2007 Li et al. ..... 175/26
2007/0030762 A1 2/2007 Huang et al. ..... 367/83
2007/0103271 A1* 5/2007 King ..... B60R 25/24 340/5.72
2007/0139217 A1 6/2007 Beique et al. ..... 340/856.3
2007/0146351 A1* 6/2007 Katsurahira ..... G06F 3/03545 345/179
2007/0219758 A1* 9/2007 Bloomfield ..... G01V 11/002 702/190
2007/0263488 A1* 11/2007 Clark ..... E21B 47/12 367/87
2008/0070614 A1* 3/2008 Ogushi ..... H04W 52/0216 455/522
2008/0093069 A1* 4/2008 O'Malley ..... E21B 17/023 166/250.01
2008/0112262 A1* 5/2008 Tang ..... E21B 47/0005 367/35
2008/0159073 A1* 7/2008 Chen ..... G01V 3/265 367/25
2008/0253228 A1* 10/2008 Camwell ..... E21B 47/12 367/82
2009/0045974 A1 2/2009 Patel ..... 340/854.6
2009/0080291 A1* 3/2009 Tubel ..... E21B 41/0035 367/81
2009/0159272 A1 6/2009 Auzerias et al. ..... 166/250.01
2009/0264956 A1 10/2009 Rise et al. ..... 607/45
2009/0277688 A1 11/2009 Oothoudt ..... 175/57
2009/0289808 A1 11/2009 Prammer ..... 340/853.7
2010/0002615 A1* 1/2010 Gupta ..... H04W 52/0229 370/311
2010/0013663 A1 1/2010 Cayender et al. ..... 340/854.3
2010/0032210 A1* 2/2010 Teodorescu ..... E21B 47/011 175/40
2010/0126718 A1 5/2010 Lilley ..... 166/253.1
2010/0154531 A1* 6/2010 Han ..... E21B 47/082 73/152.47
2010/0157739 A1 6/2010 Slocum et al. ..... 367/131
2010/0176813 A1 7/2010 Simon ..... 324/339
2010/0194584 A1 8/2010 Savage ..... 340/853.1
2010/0214107 A1* 8/2010 Montebovi ..... H02J 7/0042 340/636.1
2011/0066378 A1 3/2011 Lerche et al. ..... 702/6
2011/0168403 A1 7/2011 Patel ..... 166/373
2011/0186290 A1* 8/2011 Roddy ..... E21B 43/25 166/253.1
2011/0275313 A1* 11/2011 Baldemair ..... H04B 7/15542 455/17
2011/0280294 A1 11/2011 Luo et al. ..... 375/224
2011/0297376 A1 12/2011 Holderman et al. ..... 166/278
2012/0017673 A1 1/2012 Godager ..... 73/152.51
2012/0024050 A1 2/2012 Godager ..... 73/152.05
2012/0024052 A1 2/2012 Eriksen ..... 73/152.51
2012/0043079 A1 2/2012 Wassouf et al. ..... 166/250.01
2012/0076212 A1* 3/2012 Zeppetelle ..... H04B 3/54 375/259
2012/0090687 A1 4/2012 Grisby et al. ..... 137/1
2012/0099550 A1* 4/2012 Jia ..... H04W 76/11 370/329
2012/0170410 A1 7/2012 Hay ..... 367/82
2012/0179377 A1* 7/2012 Lie ..... E21B 47/101 702/6
2012/0223678 A1* 9/2012 Yokoura ..... H01M 10/4207 320/128
2012/0241172 A1 9/2012 Ludwig et al. ..... 166/382
2012/0256415 A1 10/2012 Dole ..... 285/337
2012/0256492 A1 10/2012 Song et al. ..... 307/66
2012/0257475 A1 10/2012 Luscombe et al. ..... 367/25
2013/0003503 A1* 1/2013 L'Her ..... G01V 1/3817 367/106
2013/0008648 A1 1/2013 Lovorn et al. ..... 166/250.01
2013/0065584 A1* 3/2013 Lyon ..... H04W 28/06 455/434
2013/0106615 A1* 5/2013 Prammer ..... G01V 3/30 340/854.6
2013/0110402 A1 5/2013 Godager ..... 702/7
2013/0118315 A1* 5/2013 Barnett ..... B25B 17/00 81/57.16
2013/0168081 A1* 7/2013 Yang ..... E21B 47/12 166/247
2013/0175094 A1 7/2013 Ross et al. ..... 175/57
2013/0248172 A1 9/2013 Angeles Boza et al. ..... 166/250.01
2013/0248174 A1 9/2013 Dale et al. ..... 166/255.01
2013/0272708 A1* 10/2013 Mizuguchi ..... H04B 10/27 398/71
2013/0294203 A1* 11/2013 Goodman ..... H04R 17/00 367/164
2013/0341094 A1* 12/2013 Taherian ..... E21B 47/14 175/40
2014/0079242 A1* 3/2014 Nguyen ..... H04R 5/00 381/86
2014/0152659 A1 6/2014 Davidson et al. ..... 345/420
2014/0170025 A1* 6/2014 Weiner ..... G01N 27/12 422/82.01
2014/0266769 A1 9/2014 van Zelm ..... 340/854.3
2014/0269188 A1* 9/2014 van Zelm ..... E21B 47/12 367/81
2014/0327552 A1 11/2014 Filas et al. ..... 340/854.6
2014/0352955 A1 12/2014 Tubel et al. ..... 166/250.15
2015/0003202 A1* 1/2015 Palmer ..... E21B 47/16 367/82
2015/0009040 A1 1/2015 Bowles et al. ..... 340/854.6
2015/0015413 A1* 1/2015 Gao ..... E21B 47/16 340/854.4
2015/0027687 A1 1/2015 Tubel ..... 166/72
2015/0285065 A1* 10/2015 Howell ..... E21B 47/0005 367/82

FOREIGN PATENT DOCUMENTS

WO WO2010/074766 7/2010 ..... A41C 1/14
WO WO2013/079928 6/2013 ..... E21B 17/00
WO WO2013/079929 6/2013 ..... E21B 21/10
WO WO2013/112273 8/2013 ..... E21B 47/12
WO WO2014/018010 1/2014 ..... E21B 47/00
WO WO2014/049360 4/2014 ..... E21B 47/12
WO WO2014/134741 9/2014 ..... E21B 47/13

OTHER PUBLICATIONS

U.S. Dept. of Defense (1999) "Department of Defense Interface Standard—Interoperability and Performance Standards for Medium and High Frequency Radio Systems," *Department of Defense*, Mar. 1999, 584 pgs.

* cited by examiner

TELEMETRY FOR WIRELESS ELECTRO-ACOUSTICAL TRANSMISSION OF DATA ALONG A WELLBORE

CROSS-REFERENCE TO RELATED APPLICATIONS

This application is a divisional of U.S. patent application Ser. No. 14/434,734 filed Apr. 9, 2015, which is the National Stage of International Application No. PCT/US2013/076269 filed Dec. 18, 2013, which claims the benefit of U.S. Ser. No. 61/739,414, filed Dec. 19, 2012, the entire contents of which are hereby incorporated by reference herein. This application is further related to U.S. Ser. Nos. 61/739,679, 61/739,677, 61/739,678, and 61/739,681, each filed on Dec. 19, 2012, the entire contents of each of which are also hereby incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present invention relates to the field of data transmission along a tubular body, such as a steel pipe. More specifically, the invention relates to the transmission of data along a pipe within a wellbore or along a pipeline at the surface or in a body of water. The present invention further relates to a wireless transmission system for transmitting data up a drill string during a drilling operation or along the casing during drilling or production operations. The present invention further relates to the use of acoustic telemetry signals along a wellbore to optimize communication protocol for speed, for power conservation and for low error rates.

GENERAL DISCUSSION OF TECHNOLOGY

It is desirable to transmit data along a pipeline without the need for wires or radio frequency (electromagnetic) communications devices. Examples abound where the installation of wires is either technically difficult or economically impractical. The use of radio transmission may also be impractical or unavailable in cases where radio-activated blasting is occurring, or where the attenuation of radio waves near the tubular body is significant.

Likewise, it is desirable to collect and transmit data along a tubular body in a wellbore, such as during a drilling process. In the drilling of oil and gas wells, a wellbore is formed using a drill bit that is urged downwardly at a lower end of a drill string. The drill bit is rotated while force is applied through the drill string and against the rock face of the formation being drilled. During this process, the operator may seek to acquire real time data related to temperature, pressure, rate of rock penetration, inclination, azimuth, fluid composition, and local geology. In order to obtain such information, special downhole assemblies have been developed. These assemblies are generally referred to as Logging While Drilling (LWD) or Measurement While Drilling (MWD) assemblies, or generically as bottom hole assemblies.

LWD and MWD assemblies are typically placed proximate the drill bit at the bottom of the drill string. Bottom hole assemblies having LWD or MWD capabilities are able to store or transmit information about subsurface conditions for review by drilling or production operators at the surface. LWD and MWD techniques generally seek to reduce the need for tripping the drill string and running wireline logs to obtain downhole data.

A variety of technologies have been proposed or developed for downhole communications using LWD or MWD. In one form, MWD and LWD information is simply stored in a microprocessor having memory. The microprocessor is retrieved and the information is downloaded later when the drill string is pulled, such as when a drill bit is changed out or a new bottom hole assembly is installed.

Several real time data telemetry systems have also been offered. One involves the use of a physical cable such as an electrical conductor or a fiber optic cable that is secured to the tubular body. The cable may be secured to either the inner or the outer diameter of the pipe. The cable provides a hard wire connection that allows for real-time transmission of data and the immediate evaluation of subsurface conditions. Further, these cables allow for high data transmission rates and the delivery of electrical power directly to downhole sensors.

It can be readily perceived that the placement of a physical cable along a string of drill pipe during drilling is problematic. In this respect, the cable will become quickly tangled and will break if secured along a rotating drill string. This problem is lessened when a downhole mud motor is used that allows for a generally non-rotating drill pipe. However, even in this instance the harsh downhole environment and the considerable force of the pipe as it scrapes across the surrounding borehole can impair the cable.

It has been proposed to place a physical cable along the outside of a casing string during well completion. However, this can be difficult as the placement of wires along a pipe string requires that thousands of feet of cable be carefully unspooled and fed during pipe connection and run-in. Further, the use of hard wires in a well completion requires the installation of a specially-designed well head that includes through-openings for the wires. In addition, if the wire runs outside of a casing string, this creates a potential weak spot in the cement sheath that may contribute to a loss of pressure isolation between subsurface intervals. It is generally not feasible to pass wires through a casing mandrel for subsea applications. In sum, passing cable in the annulus adds significant cost, both for equipment and for rig time, to well completions.

Mud pulse telemetry, or mud pressure pulse transmission, is commonly used during drilling to obtain data from sensors at or near the drill bit. Mud pulse telemetry employs variations in pressure in the drilling mud to transmit signals from the bottom hole assembly to the surface. The variations in pressure may be sensed and analyzed by a computer at the surface.

A downside to mud pulse telemetry is that it transmits data to the surface at relatively slow rates, typically at rates of less than 20 bits per second (bps). This rate decreases as the length of the wellbore increases, even down to 10 or fewer bps. Slow data transmission rates can be costly to the drilling process. For example, the time it takes to downlink instructions and uplink survey data (such as azimuth and inclination), during which the drill string is normally held stationary, can be two to seven minutes. Since many survey stations are typically required, this downlink/uplink time can be very expensive, especially on deepwater rigs where daily operational rates can exceed $2 million. Similarly, the time it takes to downlink instructions and uplink data associated with many other tasks such as setting parameters in a rotary steerable directional drilling tool or obtaining a pressure reading from a pore-pressure-while-drilling tool can be very costly.

The use of acoustic telemetry has also been suggested. Acoustic telemetry employs an acoustic signal generated at or near the bottom hole assembly or bottom of a pipe string. The signal is transmitted through the wellbore pipe, meaning that the pipe becomes the carrier medium for sound waves. Transmitted sound waves are detected by a receiver and converted to electrical signals for analysis.

U.S. Pat. No. 5,924,499 entitled "Acoustic Data Link and Formation Property Sensor for Downhole MWD System" teaches the use of acoustic signals for "short hopping" a component along a drill string. Signals are transmitted from the drill bit or from a near-bit sub and across the mud motors. This may be done by sending separate acoustic signals simultaneously—one that is sent through the drill string, a second that is sent through the drilling mud, and optionally, a third that is sent through the formation. These signals are then processed to extract readable signals.

U.S. Pat. No. 6,912,177, entitled "Transmission of Data in Boreholes." addresses the use of an acoustic transmitter that is part of a downhole tool. Here, the transmitter is provided adjacent a downhole obstruction such as a shut-in valve along a drill stem so that an electrical signal may be sent across the drill stem. U.S. Pat. No. 6,899,178, entitled "Method and System for Wireless Communications for Downhole Applications," describes the use of a "wireless tool transceiver" that utilizes acoustic signaling. Here, an acoustic transceiver is in a dedicated tubular body that is integral with a gauge and/or sensor. This is described as part of a well completion.

Faster data transmission rates with some level of clarity have been accomplished using electromagnetic (EM) telemetry. EM telemetry employs electromagnetic waves, or alternating current magnetic fields, to "jump" across pipe joints. In practice, a specially-milled drill pipe is provided that has a conductor wire machined along an inner diameter. The conductor wire transmits signals to an induction coil at the end of the pipe. The induction coil, in turn, then transmits an EM signal to another induction coil, which sends that signal through the conductor wire in the next pipe. Thus, each threaded connection provides a pair of specially milled pipe ends for EM communication.

National Oilwell Varco® of Houston, Tex. offers a drill pipe network, referred to as IntelliServ®, that uses EM telemetry. The IntelliServ® system employs drill pipe having integral wires that can transmit LWD/MWD data to the surface at speeds of up to 1 Mbps. This creates a communications system from the drill string itself. The IntelliServ® communications system uses an induction coil built into both the threaded box and pin ends of the drill pipe joints so that data may be transmitted across each connection. Examples of IntelliServ® patents are U.S. Pat. No. 7,277,026 entitled "Downhole Component With Multiple Transmission Elements," and U.S. Pat. No. 6,670,880 entitled "Downhole Data Transmission System."

It is observed that the induction coils in an EM telemetry system must be precisely located in the box and pin ends of the joints of the drill string to ensure reliable data transfer. For a long (e.g., 20,000 foot) well, there can be more than 600 tool joints. This represents over 600 pipe sections to be threadedly connected. Further, each threaded connection is preferably tested at the drilling platform to ensure proper functioning.

National Oilwell Varco® promotes its IntelliServ® system as providing the oil and gas industry's "only high-speed, high-volume, high-definition, bi-directional broadband data transmission system that enables downhole conditions to be measured, evaluated, monitored and actuated in real time." However, the IntelliServ® system generally requires the use of booster assemblies along the drill string. These can be three to six foot sub joints having a diameter greater than the drill pipe placed in the drill string. The booster assemblies, referred to sometimes as "signal repeaters," are located along the drill pipe about every 1,500 feet. The need for repeaters coupled with the need for specially-milled pipe can make the IntelliServ® system a very expensive option.

Recently, the use of radiofrequency signals has been suggested. This is offered in U.S. Pat. No. 8,242,928 entitled "Reliable Downhole Data Transmission System." This patent suggests the use of electrodes placed in the pin and box ends of pipe joints. The electrodes are tuned to receive RF signals that are transmitted along the pipe joints having a conductor material placed there along, with the conductor material being protected by a special insulative coating.

While high data transmission rates can be accomplished using RF signals in a downhole environment, the transmission range is typically limited to a few meters. This, in turn, requires the use of numerous repeaters.

Accordingly, a need exists for a high speed wireless transmission system in a wellbore that does not require the machining of induction coils with precise grooves placed into pipe ends or the need for electrodes in the pipe ends or couplings. Further, a need exists for such a wireless transmission system that does not require the precise alignment of induction coils or the placement of RF electrodes between pipe joints.

SUMMARY OF THE INVENTION

A system for downhole telemetry is provided herein. The system employs a series of autonomous communications nodes spaced along a wellbore. The nodes allow for wireless communication between one or more sensors residing at the level of a subsurface formation, and a receiver at the surface.

The system first includes a tubular body disposed in the wellbore. Where the wellbore is being formed, the tubular body is a drill string, with the wellbore progressively penetrating into a subsurface formation. The subsurface formation preferably represents a rock matrix having hydrocarbon fluids available for production in commercially acceptable volumes. Thus, the wellbore is to be completed as a production well, or "producer." Alternatively, the wellbore is to be completed as an injection well or a formation monitoring well.

In another aspect, the wellbore has already been completed. The tubular body is then a casing string or, alternatively, a production string such as tubing.

The system also includes at least one sensor. As noted, the sensor is disposed along the wellbore at a depth of the subsurface formation. The sensor may be, for example, a temperature sensor, a pressure sensor, a microphone, a geophone, a vibration sensor, a resistivity sensor, a fluid flow measurement device, a chemical composition or pH sensor, a formation density sensor, a fluid identification sensor, or a strain gauge. Where the wellbore is being drilled, the sensor may alternatively be a set of position sensors indicating, inclination, azimuth, and orientation.

The system further has one or more a sensor communications nodes. The sensor communications nodes are placed along the wellbore, such as along a drill string or along a casing string. At least one of the sensor communications nodes is connected to the tubular body at the depth of the subsurface formation. The sensor communications node along the subsurface formation is in electrical communication with a sensor. Preferably, the sensor resides within a housing of the sensor communications node.

The sensor communications node is configured to receive signals from the at least one sensor. The signals represent a subsurface condition such as temperature, pressure, or logging information. The sensor communications node preferably includes a sealed housing for holding the electronics.

The system also comprises a topside communications node. The topside communications node is placed proximate the surface, such as on the wellhead or other near-surface equipment in acoustic communication with downhole tubular bodies. In one aspect, the topside communications node is connected to the wellhead. The surface may be an earth surface. Alternatively, in a subsea context, the surface may be an offshore drilling or production platform.

The system further includes a plurality of intermediate communications nodes. The intermediate communications nodes are attached to the tubular body in spaced-apart relation. In one aspect, the intermediate communications nodes are spaced at about 10 to about 100 foot (~3 meter to ~30 meter) intervals. The intermediate communications nodes are configured to relay messages between from the sensor communications node and the topside communications node. In one embodiment, the sensor communications node is fully housed with the intermediate communications node.

Each of the intermediate communications nodes has an independent power source. The power source may be, for example, batteries or a fuel cell. In addition, each of the intermediate communications nodes has an electro-acoustic transducer and associated transceiver that is used to establish telemetry. The transceiver is designed to receive and transmit acoustic waves at a frequency range enabling (i) node-to-node acoustic transmission and (ii) a modulation scheme permitting the transfer of information.

The acoustic waves represent the readings taken and data generated by the sensor. In this way, data about subsurface conditions are transmitted wirelessly from node-to-node up to the surface. The acoustic waves represent asynchronous packets of information comprising a plurality of tones. Each tone may have a non-prescribed amplitude, a non-prescribed reverberation time, or both. In one aspect, the communications nodes transmit data as mechanical waves at a rate exceeding about 50 bps. In a preferred embodiment, multiple frequency shift keying (MFSK) is the modulation scheme enabling the transmission of information.

A method of transmitting data in a wellbore is also provided herein. The method uses a plurality of data transmission nodes situated along a tubular body to accomplish a wireless transmission of data along the wellbore. The wellbore penetrates into a subsurface formation, allowing for the communication of a wellbore condition at the level of the subsurface formation up to the surface.

The method first includes running a tubular body into the wellbore. The tubular body is formed by connecting a series of pipe joints end-to-end.

The method also includes placing at least one sensor along the wellbore at a depth of the subsurface formation. The sensor may be a pressure sensor, a temperature sensor, a set of position sensors, a vibration sensor, a formation density sensor, a strain gauge, a sonic velocity sensor, a resistivity sensor, or other chemical or physical sensor.

The method further includes attaching a sensor communications node to the tubular body. The sensor communications node is then placed at the depth of the subsurface formation. The sensor communications node is in electrical (or, optionally, optical) communication with the at least one sensor. This communication may be by means of a short wired connection. In one aspect, the sensor resides in the housing of a sensor communications node.

The sensor communications node is configured to receive signals from the at least one sensor. The signals represent a subsurface condition as detected by the sensor. In one embodiment, the sensor is the same electro-acoustic transducer that enables the telemetry communication. In this way, amplitude and amplitude attenuation values may be analyzed.

The method also provides for attaching a topside communications node to the tubular body or other structure, such as the well head or the blow out preventer (BOP), that is connected to the tubular body. The topside communications node is attached to the tubular body proximate the surface.

The method further comprises attaching a plurality of intermediate communications nodes to the tubular body. The intermediate communications nodes reside in spaced-apart relation along the tubular body between the sensor communications node and the topside communications node. The intermediate communications nodes are configured to relay sensor data via acoustic waves from the sensor communications node to the topside node. The intermediate communications nodes are configured as described above to send asynchronous packets of information. Preferably, a sliding alphabet algorithm is employed for signal processing as a method of reducing adverse impact of reverberation during transmission and reception of messages. In one aspect, the algorithm eliminates the occurrence of two of the same tones sent consecutively (given a set of defined tones associated with defined frequencies) during a MFSK communication.

In a preferred embodiment, the attaching steps comprise clamping the various communications nodes, that is, at least the sensor communications nodes and the intermediate communications nodes, to the tubular body. These communications nodes are welded or otherwise pre-attached to one or more clamps, which are then secured around the tubular body during run-in.

In one aspect, the method further includes receiving a signal from the topside communications node at a receiver. The receiver is located at or just above the surface. The receiver preferably receives electrical or optical signals from the topside communications node. In one embodiment, the electrical or optical signals are conveyed in a conduit suitable for operation in an electrically classified area, that is, via a so-called "Class I, Division 1" conduit (as defined by NFPA 497 and API 500). Alternatively, data can be transferred from the topside communications node to a receiver via an electromagnetic (RF) wireless connection. The electrical signals may then be processed and analyzed at the surface.

As acoustic telemeter signals are sent between the transceivers downhole and a processor at the surface, the acoustic signals may change due to one or more subsurface condition changes. Such changes may include changes in the flexural wave velocity of the pipe, depending on the speed of sound (e.g. in steel, versus mud, versus air), and one or more mechanisms that will attenuate the acoustic telemetry signal as the propagation distance increases. Detection of these changes can be helpful to the operation of the electro-acoustic network as such changes can affect the delay time between individual acoustic "tones" in the packets as well as the optimal frequency band and reverberation times for transmission.

The operating protocol for the acoustic telemetry network can be adjusted after the network has been deployed. In order to implement changes to network communications, a "bi-lingual" command may be sent. This command enables pairs of nodes to temporarily respond and transmit with both the original operating protocol and the adjusted protocol.

The changing nature of electro-acoustic waves sent and received by pairs of communication nodes can be used to infer depth-dependent properties. These may include defects in metallic tubing, defects in the coupling between lengths of tubing, and changes in fluid, solid or mixed media along a tubular joint (e.g., water, oil, gas, flowing particles).

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 5A, the leading edge, or front, of the shoe is seen. In FIG. 5B, the back of the shoe is seen.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the term "subsurface" refers to regions below the earth's surface.

As used herein, the term "sensor" includes any electrical sensing device or gauge. The sensor may be capable of monitoring or detecting pressure, temperature, fluid flow, vibration, resistivity, or other formation data.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refer to a portion of a formation containing hydrocarbons. The term "hydrocarbon-bearing formation" may alternatively be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe, such as a joint of casing, a portion of a liner, a drill string, a production tubing, an injection tubing, a pup joint, a buried pipeline, underwater piping, or above-ground pipeline. The tubular body may also be a downhole tubular device such as a joint of sand screen having a base pipe with pre-drilled holes, a slotted liner, or an inflow control device.

Description of Selected Specific Embodiments

The invention described herein in connection with certain specific embodiments. However, to the extent that the following detailed description is specific to a particular embodiment or a particular use, such is intended to be illustrative only and is not to be construed as limiting the scope of the inventions.

Figure 1:
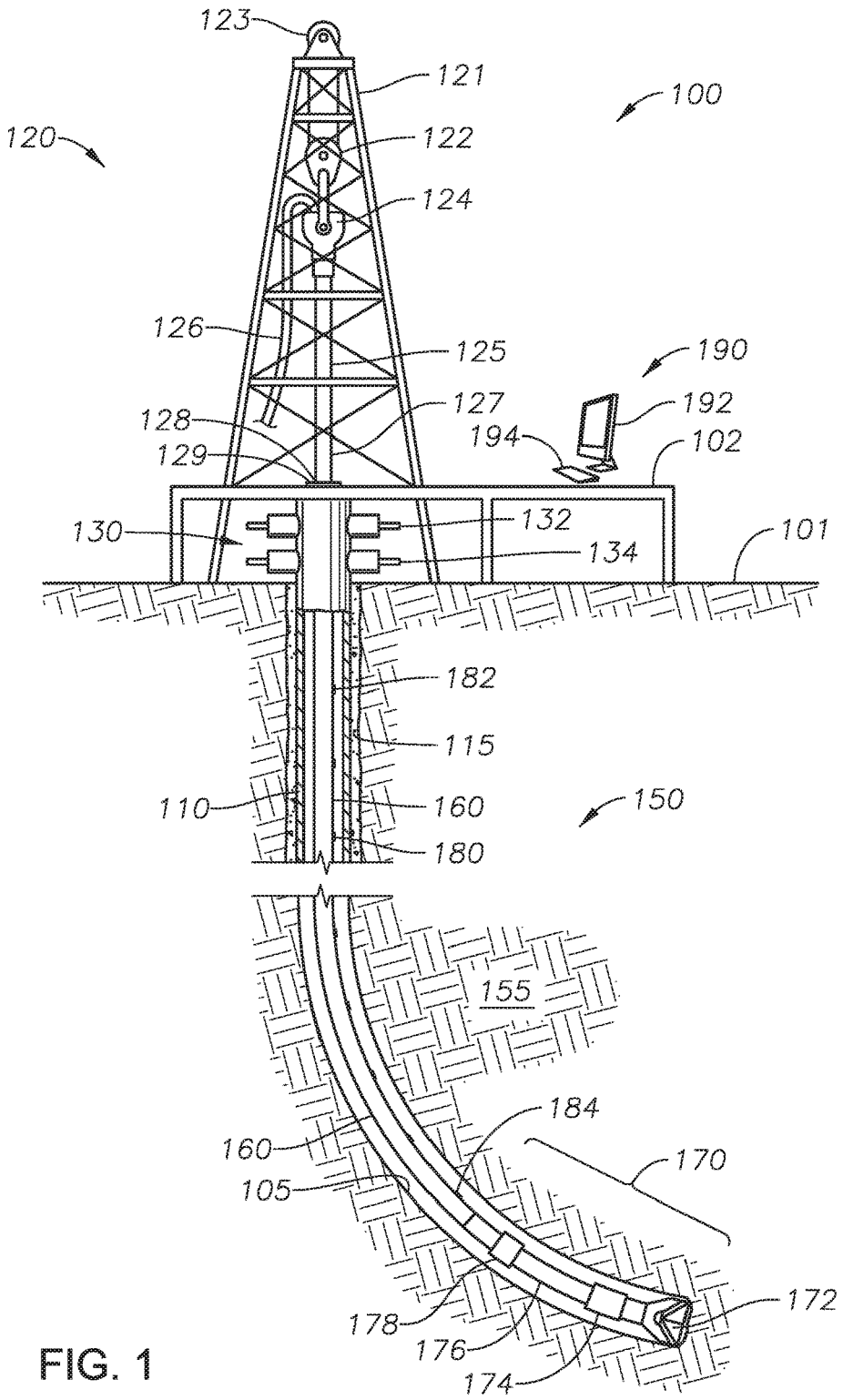
FIG. 1 is a side, cross-sectional view of an illustrative wellbore. The wellbore is being formed using a derrick, a drill string and a bottom hole assembly. A series of communications nodes is placed along the drill string as part of a telemetry system.

FIG. 1 is a side, cross-sectional view of an illustrative well site 100. The well site 100 includes a derrick 120 at an earth surface 101, and a wellbore 150 extending from the earth surface 101 into an earth subsurface 155. The wellbore 150 is being formed using the derrick 120, a drill string 160 below the derrick 120, and a bottom hole assembly 170 at a lower end of the drill string 160.

Referring first to the derrick 120, the derrick 120 includes a frame structure 121 that extends up from the earth surface 101 and which supports drilling equipment. The derrick 120 also includes a traveling block 122, a crown block 123 and a swivel 124. A so-called kelly 125 is attached to the swivel 124. The kelly 125 has a longitudinally extending bore (not shown) in fluid communication with a kelly hose 126. The kelly hose 126, also known as a mud hose, is a flexible, steel-reinforced, high-pressure hose that delivers drilling fluid through the bore of the kelly 125 and down into the drill string 160.

The kelly 125 includes a drive section 127. The drive section 127 is non-circular in cross-section and conforms to an opening 128 longitudinally extending through a kelly drive bushing 129. The kelly drive bushing 129 is part of a rotary table. The rotary table is a mechanically driven device that provides clockwise (as viewed from above) rotational force to the kelly 125 and connected drill string 160 to facilitate the process of drilling a borehole 105. Both linear and rotational movement may thus be imparted from the kelly 125 to the drill string 160.

A platform 102 is provided for the derrick 120. The platform 102 extends above the earth surface 101. The platform 102 generally supports rig hands along with various components of drilling equipment such as a pumps, motors, gauges, a dope bucket, pipe lifting equipment and control equipment. The platform 102 also supports the rotary table.

It is understood that the platform 102 shown in FIG. 1 is somewhat schematic. It is also understood that the platform 102 is merely illustrative and that many designs for drilling rigs, both for onshore and for offshore operations, exist. The claims provided herein are not limited by the configuration and features of the drilling rig unless expressly stated in the claims.

Placed below the platform 102 and the kelly drive section 127 but above the earth surface 101 is a blow-out preventer, or BOP 130. The BOP 130 is a large, specialized valve or set of valves used to control pressures during the drilling of oil and gas wells. Specifically, blowout preventers control the fluctuating pressures emanating from subterranean formations during a drilling process. The BOP 130 may include upper 132 and lower 134 rams used to isolate flow on the back side of the drill string 160. Blowout preventers 130 also prevent the pipe joints making up the drill string 160 and the drilling fluid from being blown out of the wellbore 150 when a blowout threatens.

As shown in FIG. 1, the wellbore 150 is being formed down into the subsurface formation 155. In addition, the wellbore 150 is being shown as a deviated wellbore. Of course, this is merely illustrative as the wellbore 150 may be a vertical well or even a horizontal well, as shown later in FIG. 2.

In drilling the wellbore 150, a first string of casing 110 is placed down from the surface 101. This is known as surface casing 110 or, in some instances (particularly offshore conductor pipe. The surface casing 110 is secured within the formation 155 by a cement sheath. The cement sheath resides within an annular region 115 between the surface casing 110 and the surrounding formation 155.

During the process of drilling and completing the wellbore 150, additional strings of casing (not shown) will be provided. These may include intermediate casing strings and a final production casing string. For the final production casing, a liner may be employed, that is, a string of casing that is not tied back to the surface 101.

As noted, the wellbore 150 is formed by using a bottom hole assembly 170. The bottom-hole assembly 170 allows the operator to control or "steer" the direction or orientation of the wellbore 150 as it is formed. In this instance, the bottom hole assembly 170 is known as a rotary steerable drilling system, or RSS.

The bottom hole assembly 170 will include a drill bit 172. The drill bit 172 may be turned by rotating the drill string 160 from the platform 102. Alternatively, the drill bit 172 may be turned by using so-called mud motors 174. The mud motors 174 are mechanically coupled to and turn the nearby drill bit 172. The mud motors 174 are used with stabilizers or bent subs 176 to impart an angular deviation to the drill bit 172. This, in turn, deviates the well from its previous path in the desired azimuth and inclination.

There are several advantages to directional drilling. These primarily include the ability to complete a wellbore along a substantially horizontal axis of a subsurface formation, thereby exposing a substantially greater formation face. These also include the ability to penetrate into subsurface formations that are not located directly below the wellhead. This is particularly beneficial where an oil reservoir is located under an urban area or under a large body of water. Another benefit of directional drilling is the ability to group multiple wellheads on a single platform, such as for offshore drilling. Finally, directional drilling enables multiple laterals and/or sidetracks to be drilled from a single wellbore in order to maximize reservoir exposure and recovery of hydrocarbons.

The illustrative well site 100 also includes a sensor 178. Here, the sensor 178 is part of the bottom hole assembly 170. The sensor 178 may be, for example, a set of position sensors that is part of the electronics for a RSS. Alternatively or in addition, the sensor 178 may be a temperature sensor, a pressure sensor, or other sensor for detecting a downhole condition during drilling. Alternatively still, the sensor may be an induction log or gamma ray log or other log that detects fluid and/or geology downhole.

The sensor 178 is part of a MWD or a LWD assembly. It is observed that the sensor 178 is located above the mud motors 174. This is a common practice for MWD assemblies. This allows the electronic components of the sensor 178 to be spaced apart from the high vibration and centrifugal forces acting on the bit 172.

Where the sensor 178 is a set of position sensors, the sensors may include three inclinometer sensors and three environmental acceleration sensors. Ideally, a temperature sensor and a wear sensor will also be placed in the drill bit 172. These signals are input into a multiplexer and transmitted.

It is desirable to send signals about the downhole condition back to an operator at the surface 101. To do this, a telemetry system is used. As discussed above, various telemetry systems are known in the industry. However, the well site 100 of FIG. 1 presents a telemetry system that utilizes a series of novel communications nodes 180 placed along the drill string 160. These nodes 180 allow for the high speed transmission of wireless signals based on the in situ generation of acoustic waves.

The nodes first include a topside communications node 182. The topside communications node 182 is placed closest to the surface 101. The topside node 182 is configured to receive and/or transmit acoustic signals. The topside communications node can is preferably above grade and on the wellhead.

The nodes may also include a sensor communications node 184. The sensor communications node is placed closest to the sensor 178. The sensor communications node 184 is configured to communicate with the downhole sensor 178, and then send a wireless signal using an acoustic wave.

Finally, the nodes include a plurality of intermediate communications nodes 180. Each of the intermediate communications nodes 180 resides between the sensor node 182 and the topside node 184. The intermediate communications nodes 180 are configured to receive and then relay acoustic signals along the length of the wellbore 150. Preferably, the intermediate communications nodes 180 utilize two-way electro-acoustic transducers to both receive and relay mechanical waves. In one embodiment, the sensor communications node is fully housed with the intermediate communications node.

In FIG. 1, the nodes 180 are shown schematically. However, FIG. 3 offers an enlarged perspective view of an illustrative pipe joint 300, along with an illustrative intermediate communications node 350. The illustrative communications node 350 is shown exploded away from the pipe joint 300.

Figure 3:
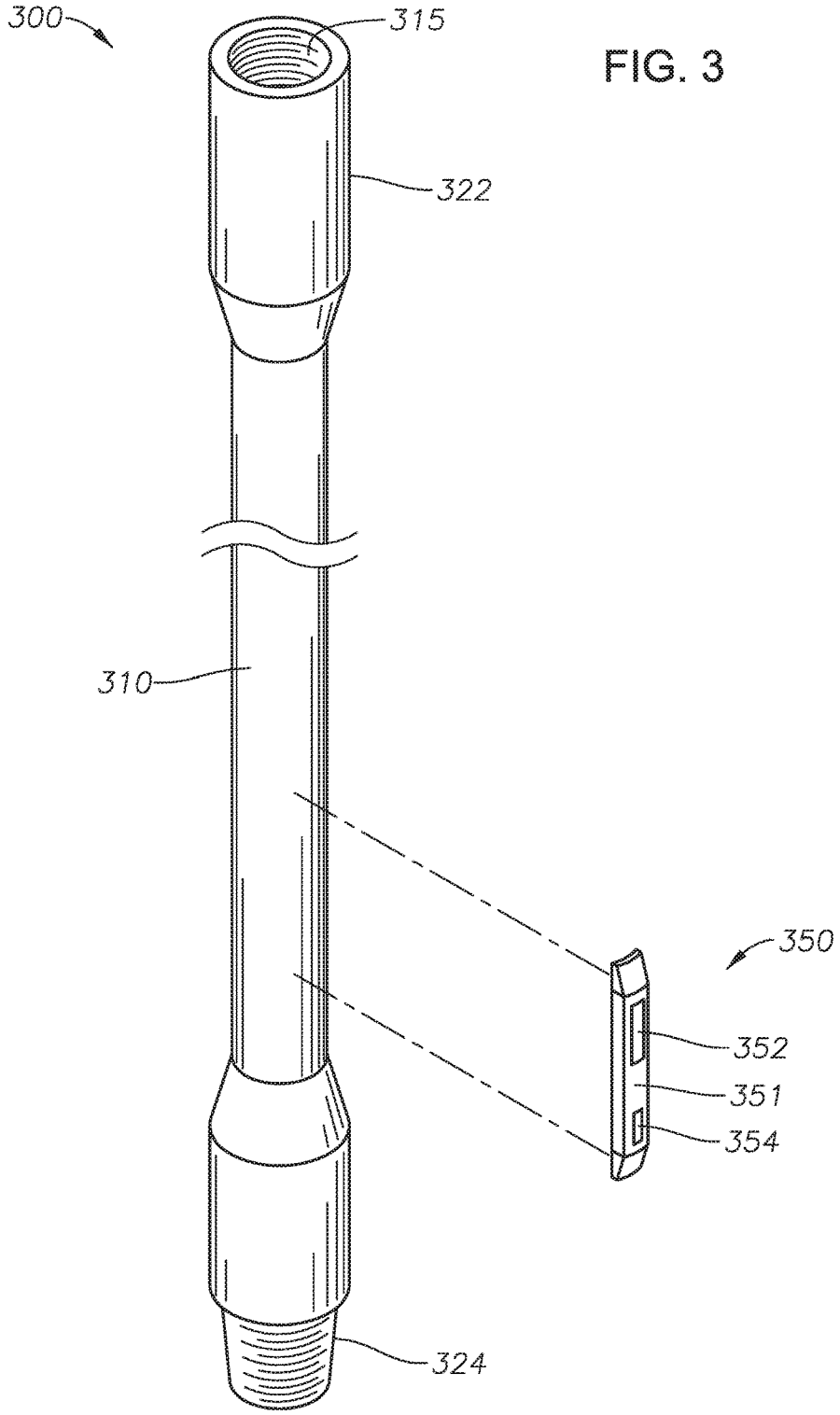
FIG. 3 is a perspective view of an illustrative pipe joint. A communications node (such as a sensor communications node or an intermediate communications node) of the present invention, in one embodiment, is shown exploded away from the pipe joint.

In FIG. 3, the pipe joint 300 is intended to represent a joint of drill pipe. However, the pipe joint 300 may be any other tubular body such as a joint of tubing or a portion of pipeline. The pipe joint 300 has an elongated wall 310 defining an internal bore 315. The bore 315 transmits drilling fluids such as an oil based mud, or OBM, during a drilling operation. The pipe joint 300 has a box end 322 having internal threads, and a pin end 324 having external threads.

As noted, an illustrative intermediate communications node 350 is shown exploded away from the pipe joint 300. The communications node 350 is designed to attach to the wall 310 of the pipe joint 300 at a selected location. In one aspect, selected pipe joints 300 will each have an intermediate communications node 350 between the box end 322 and the pin end 324. In one arrangement, the communications node 350 is placed immediately adjacent the box end 322 or, alternatively, immediately adjacent the pin end 324 of every joint of pipe. In another arrangement, the communications node 350 is placed at a selected location along every second or every third pipe joint 300 in a drill string 160. In other aspects, more or less than one intermediate communications node may be placed per joint 300.

The intermediate communications node 350 shown in FIG. 3 is designed to be pre-welded onto the wall 310 of the pipe joint 300. However, it is preferred that the communications node 350 be configured to be selectively attachable to/detachable from a pipe joint 300 by mechanical means at a well site. This may be done, for example, through the use of clamps. Such a clamping system is shown at 600 in FIG. 6, described more fully below. Alternatively, an epoxy or other suitable acoustic couplant may be used for chemical bonding. In any instance, the communications node 350 is an independent wireless communications device that is designed to be attached to an external surface of a well pipe, a coupling or a liner.

There are several benefits to the use of an externally-placed communications node that uses acoustic waves. For example, such a node will not interfere with the flow of fluids within the internal bore 315 of the pipe joint 300. Further, installation and mechanical attachment can be readily assessed or adjusted, as necessary. Because the acoustic signals are carried principally by the wall 310 of the pipe joint 300 itself, the MFSK data content is largely unaffected by the fluids in the pipe joint 300.

In FIG. 3, the intermediate communications node 350 includes an elongated body 351. The body 351 supports one or more batteries, shown schematically at 352. The body 351 also supports an electro-acoustic transducer, shown schematically at 354. In a preferred embodiment, the electro-acoustic transducer 354 may be a two-way transceiver that can both receive and transmit acoustic signals. The communications node 350 is intended to represent the communications nodes 180 of FIG. 1, in one embodiment. The two-way electro-acoustic transducer 354 in each node 180 allows acoustic signals to be sent from node-to-node, either up the wellbore 150 or down the wellbore 150.

Returning to FIG. 1, in operation, the sensor communications node 184 is in electrical communication with the sensor 178. This may be by means of a short wire, or by means of wireless communication such as infrared or radio-frequency communication. The sensor communications node 184 is configured to receive signals from the sensor 178, wherein the signals represent a subsurface condition such as position, temperature, pressure, resistivity, or other formation data. Preferably, the sensor is contained in the same housing as the sensor communications node 184. Indeed, the sensor may be the same electro-acoustic transducer that enables the telemetry communication.

The sensor communications node 184 transmits signals from the sensor 178 as acoustic waves. The acoustic waves are preferably at a frequency of between about 50 kHz and 500 kHz. The signals are received by an intermediate communications node 180 that is closest to the sensor communications node 184. That intermediate communications node 180, in turn, will relay the signal on to a next-closest node 180 so that acoustic waves indicative of the downhole condition are sent from node-to-node. A last intermediate communications node 180 transmits the signals acoustically to the topside communications node 182.

Communication may be between adjacent nodes, or it may occasionally skip a node depending on node spacing or communication range. Preferably, communication is routed around any nodes that are broken. Preferably, the number of nodes which transmit a communication packet is fewer than the total number of nodes between the sensor node and the topside node in order to conserve battery power and extend the operational life of the network.

The well site 100 of FIG. 1 also shows a receiver 190. The receiver 190 comprises a processor 192 that receives signals sent from the topside communications node 182. The signals may be received through a wire (not shown) such as a co-axial cable, a fiber optic cable, a USB cable, or other electrical or optical communications wire. Alternatively, the receiver 190 may receive signals from the topside communications node 182 wirelessly through a modem, a transceiver or other wireless communications link. The receiver 190 preferably receives electrical signals via a so-called Class I, Division 1 conduit, that is, a housing for wiring that is considered acceptably safe in an explosive environment. In some applications, radio, infrared or microwave signals may be utilized.

In any event, the processor 192 may be incorporated into a computer having a screen. The computer may have a separate keyboard 194, as is typical for a desk-top computer, or an integral keyboard as is typical for a laptop or a personal digital assistant. In one aspect, the processor 192 is part of a multi-purpose "smart phone" having specific "apps" and wireless connectivity.

It is noted that data may be sent along the nodes not only from the sensor 178 up to the receiver 190, but also from the receiver 190 down to the sensor 178. This transmission may be of benefit in the event that the operator wishes to make a change in the way the sensor 178 is functioning. This is also of benefit when the sensor 178 is actually another type of device, such as an inflow control device that opens, closes or otherwise actuates in response to a signal from the surface 101.

FIG. 1 demonstrates the use of a wireless data telemetry system in connection with a drilling operation. However, the wireless downhole telemetry system may also be used for a completed well.

Figure 2:
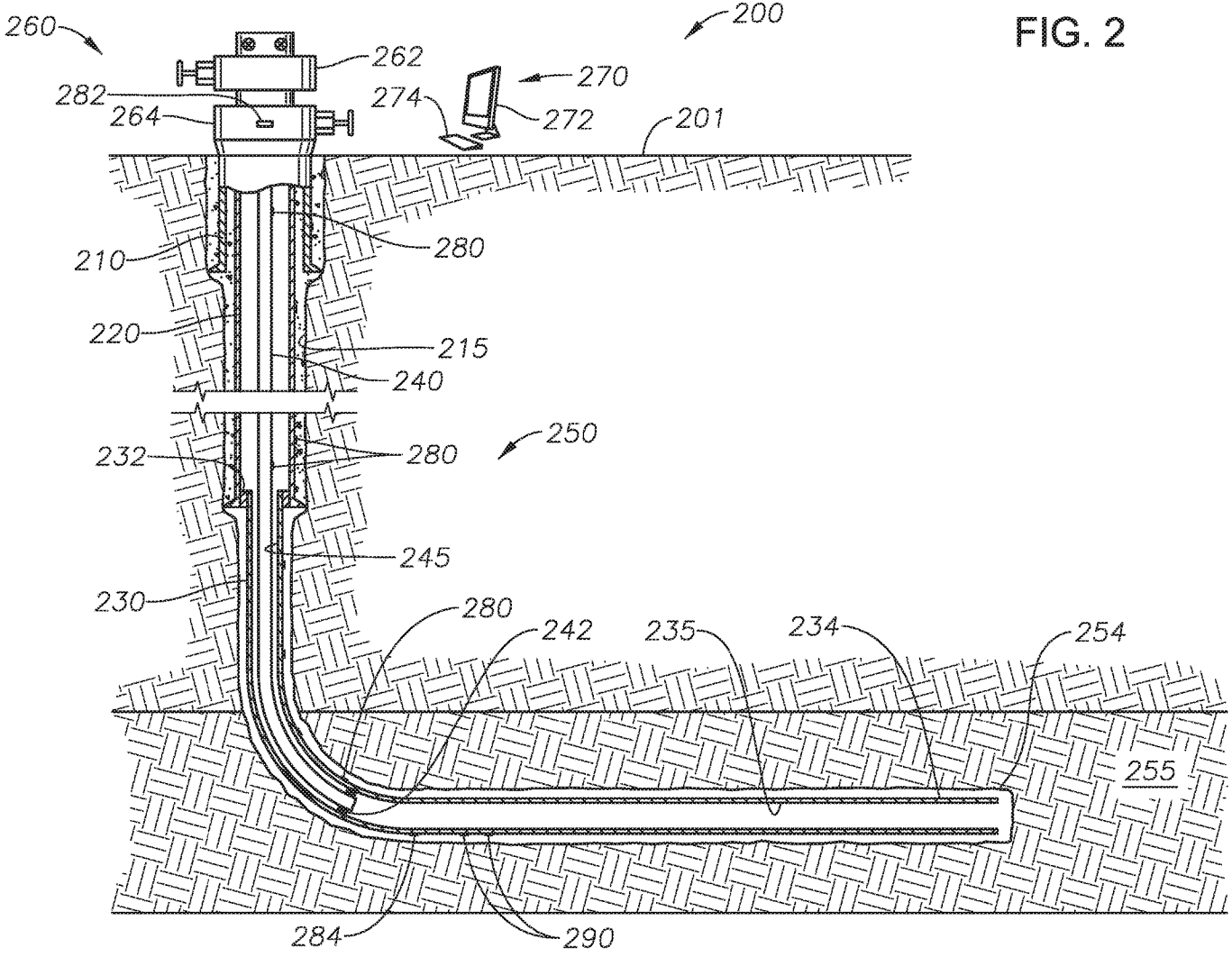
FIG. 2 is a cross-sectional view of a wellbore having been completed. The illustrative wellbore has been completed as a cased hole completion. A series of communications nodes is placed along a tubing string as part of a telemetry system.

FIG. 2 is a cross-sectional view of an illustrative well site 200. The well site 200 includes a wellbore 250 that penetrates into a subsurface formation 255. The wellbore 250 has been completed as a cased-hole completion for producing hydrocarbon fluids. The well site 200 also includes a well head 260. The well head 260 is positioned at an earth surface 201 to control and direct the flow of formation fluids from the subsurface formation 255 to the surface 201.

Referring first to the well head 260, the well head 260 may be any arrangement of pipes or valves that receive reservoir fluids at the top of the well. In the arrangement of FIG. 2, the well head 260 is a so-called Christmas tree. A Christmas tree is typically used when the subsurface formation 255 has enough in situ pressure to drive production fluids from the formation 255, up the wellbore 250, and to the surface 201. The illustrative well head 260 includes a top valve 262 and a bottom valve 264. In some contexts, these valves are referred to as "master fracture valves." Other valves may also be used.

It is understood that rather than using a Christmas tree, the well head 260 may alternatively include a motor (or prime mover) at the surface 201 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 260 may be configured to support a string of production tubing having a downhole electric submersible pump, a gas lift valve, or other means of artificial lift (not shown). The present inventions are not limited by the configuration of operating equipment at the surface unless expressly noted in the claims.

Referring next to the wellbore 250, the wellbore 250 has been completed with a series of pipe strings, referred to as casing. First, a string of surface casing 210 has been cemented into the formation. Cement is shown in an annular bore between the bore wall 215 of the wellbore 250 and the casing 210. The surface casing 210 has an upper end in sealed connection with the lower master valve 264.

Next, at least one intermediate string of casing 220 is cemented into the wellbore 250. The intermediate string of casing 220 is in sealed fluid communication with the upper master valve 262. Cement is again shown in a bore 215 of the wellbore 250. The combination of the casing strings 210, 220 and the cement sheath in the bore 215 strengthens the wellbore 250 and facilitates the isolation of formations behind the casing 210, 220.

It is understood that a wellbore 250 may, and typically will, include more than one string of intermediate casing. Some of the intermediate casing strings may be only partially cemented into place, depending on regulatory requirements and the presence of migratory fluids in any adjacent strata.

Finally, a production liner 230 is provided. The production liner 230 is hung from the intermediate casing string 230 using a liner hanger 232. A portion of the production liner 230 may optionally be cemented in place. The liner is a string of casing that is not tied back to the surface 201.

The production liner 230 has a lower end 234 that extends substantially to an end 254 of the wellbore 250. For this reason, the wellbore 250 is said to be completed as a cased-hole well. Those of ordinary skill in the art will understand that for production purposes, the liner 230 may be perforated or may include sections of slotted liner to create fluid communication between a bore 235 of the liner 230 and the surrounding rock matrix making up the subsurface formation 255.

As an alternative, portions of the liner 230 may include joints of sand screen (not shown). The use of sand screens with gravel packs allows for greater fluid communication between the bore 235 of the liner 230 and the surrounding rock matrix while still providing support for the wellbore 250. The present inventions are not limited by the nature of the completion unless expressly so stated in the claims.

The wellbore 250 also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 242 is provided at a lower end of the production tubing 240 to seal off an annular region 245 between the tubing 240 and the surrounding production liner 230. However, the production tubing 240 may extend closer to the end 234 of the liner 230.

It is also noted that the bottom end 234 of the production liner 230 is completed substantially horizontally within the subsurface formation 255. This is a common orientation for wells that are completed in so-called "tight" or "unconventional" formations. However, the present inventions have equal utility in vertically completed wells or in multi-lateral deviated wells. Further, the communications nodes 280 themselves may be used in other tubular constructions such as above-ground, under-ground, or below water pipelines.

The illustrative well site 200 also includes one or more sensors 290. Here, the sensors 290 are placed at the depth of the subsurface formation 255. The sensors 290 may be, for example, pressure sensors, flow meters, electrical impedance sensors, resistivity sensors, chemical sensors, pH sensors, or temperature sensors. A pressure sensor may be, for example, a sapphire gauge or a quartz gauge. Sapphire gauges are preferred as they are considered more rugged for the high-temperature downhole environment. Alternatively, the sensors may be microphones for detecting ambient noise, or geophones (such as a tri-axial geophone) for detecting the presence of micro-seismic activity. Alternatively still, the sensors may be fluid flow measurement devices such as a spinners, or fluid composition sensors.

It is desirable to send signals about the downhole condition back to a receiver at the surface 201. As with the well site 100 of FIG. 1, the well site 200 of FIG. 2 includes a telemetry system that utilizes a series of novel communications nodes. Here, the communications nodes are placed along the outer diameter of the string of production tubing 240. These nodes allow for the high speed transmission of wireless signals based on the in situ generation of acoustic waves.

The nodes first include a topside communications node 282. The topside communications node 282 is placed closest to the surface 201. The topside node 282 is configured to receive and/or transmit signals. The topside communications node 282 should be placed on the wellhead or next to the surface along the uppermost joint of casing 210.

The nodes also include a sensor communications node 284. The sensor communications node 284 is placed closest to the sensors 290. The sensor communications node 284 is configured to communicate with the downhole sensor 290, and then send a wireless signal using acoustic waves.

Finally, the nodes include a plurality of intermediate communications nodes 280. Each of the intermediate communications nodes 280 resides between the sensor communications node 284 and the topside communications node 282. The intermediate communications nodes 280 are configured to receive and then relay acoustic signals along the length of the tubing string 240. Preferably, the intermediate nodes 280 utilize two-way electro-acoustic transducers to receive and relay mechanical waves. The intermediate communications nodes 280 preferably reside along an outer diameter of the casing strings 210, 220, 230.

In operation, the sensor communications node 284 is in electrical communication with the (one or more) sensors 290. This may be by means of a short wire, or by means of wireless communication such as infrared or radio waves. The sensor communications node 284 is configured to receive signals from the sensors 290, wherein the signals represent a subsurface condition such as temperature or pressure. Alternatively, sensor 290 may be contained in the housing of communications node 284.

The sensor communications node 284 transmits signals from the sensors 290 as acoustic waves. The acoustic waves are preferably at a frequency band of about 50 to 100 kHz. The signals are received by an intermediate communications node 280. That intermediate communications node 280, in turn, will relay the signal on to another intermediate communications node so that acoustic waves indicative of the downhole condition are sent from node-to-node. A last intermediate communications node 280 transmits the signals to the topside node 282.

The well site 200 of FIG. 2 shows a receiver 270. The receiver 270 comprises a processor 272 that receives signals sent from the topside communications node 284. The receiver 270 may include a screen and a keyboard 274 (either as a keypad or as part of a touch screen). The receiver 270 may also be an embedded controller with neither screen nor keyboard which communicates with a remote computer via cellular modem or telephone lines.

The signals may be received by the processor 272 through a wire (not shown) such as a co-axial cable, a fiber optic cable, a USB cable, or other electrical or optical communications wire. Alternatively, the receiver 270 may receive the final signals from the topside node 282 wirelessly through a modem or transceiver. The receiver 270 preferably receives electrical signals via a so-called Class I, Division 1 conduit, that is, a wiring conduit that is considered acceptably safe in an explosive environment.

FIGS. 1 and 2 present illustrative wellbores 150, 250 having a downhole telemetry system that uses a series of acoustic transducers. In each of FIGS. 1 and 2, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down" or "upper" and "lower" or similar terms are used in reference to a drawing, they are intended to indicate relative location on the drawing page, and not necessarily orientation in the ground, as the present inventions have utility no matter how the wellbore is orientated.

In each of FIGS. 1 and 2, the communications nodes 180, 280 are specially designed to withstand the same corrosive and environmental conditions (i.e., high temperature, high pressure) of a wellbore 150 or 250 as the casing strings, drill string, or production tubing. To do so, it is preferred that the communications nodes 180, 280 include sealed steel housings for holding the electronics.

Figure 4B:
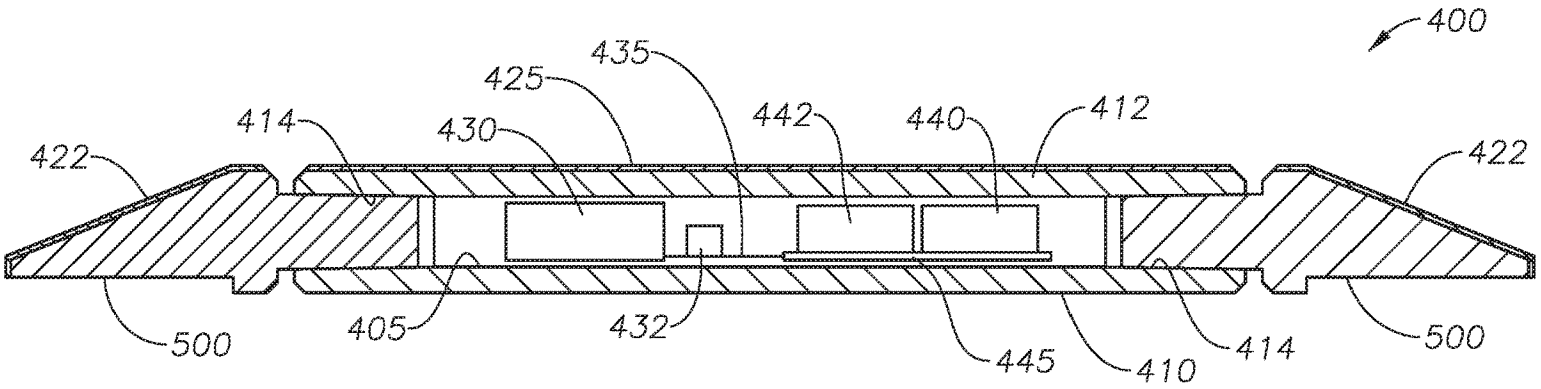
FIG. 4B is a cross-sectional view of the communications node of FIG. 4A. The view is taken along the longitudinal axis of the node. Here, a sensor is provided within the communications node.
Figure 4C:
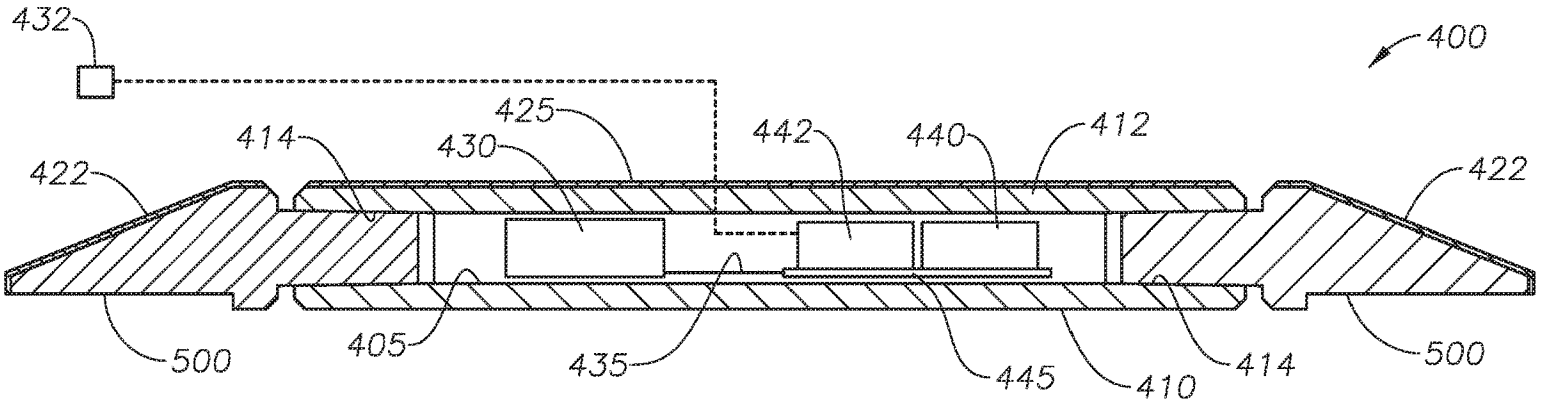
FIG. 4C is another cross-sectional view of the communications node of FIG. 4A. The view is again taken along the longitudinal axis of the node. Here, a sensor resides along the wellbore external to the communications node.
Figure 4A:
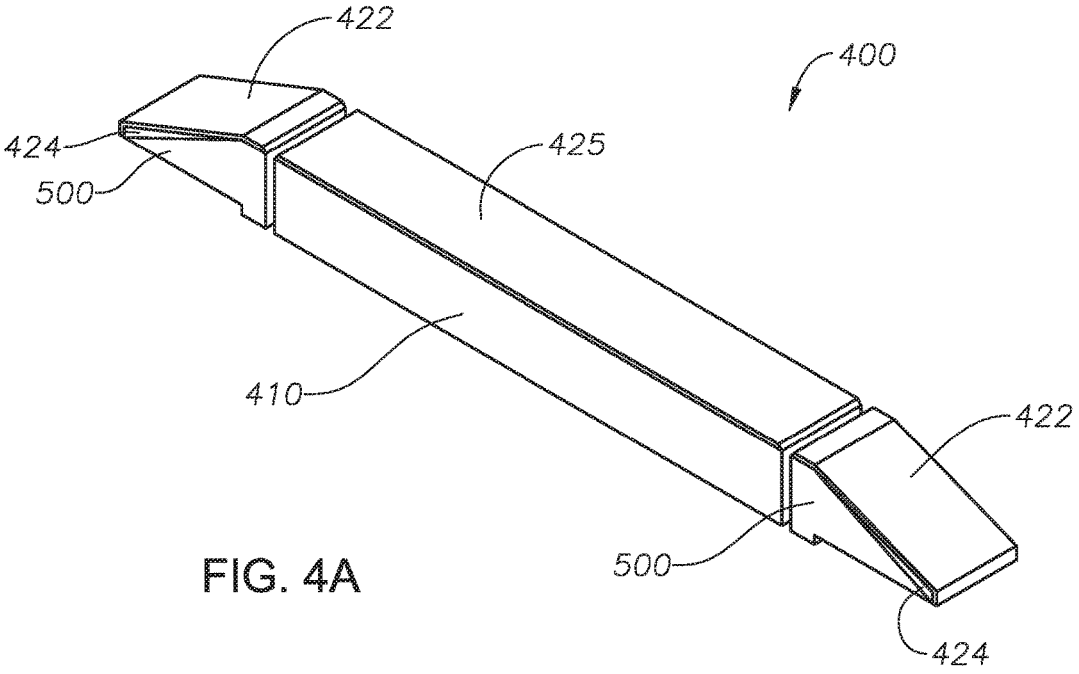
FIG. 4A is a perspective view of a communications node as may be used in the wireless data transmission system of the present invention, in an alternate embodiment.

FIG. 4A is a perspective view of a communications node 400 as may be used in the wireless data transmission systems of FIG. 1 or FIG. 2 (or other wellbore), in one embodiment. The communications node 400 may be an intermediate communications node that is designed to provide two-way communication using a transceiver within a novel downhole housing assembly. FIG. 4B is a cross-sectional view of the communications node 400 of FIG. 4A. The view is taken along the longitudinal axis of the node 400. The communications node 400 will be discussed with reference to FIGS. 4A and 4B, together.

The communications node 400 first includes a housing 410. The housing 410 is designed to be attached to an outer wall of a joint of wellbore pipe, such as the pipe joint 300 of FIG. 3. Where the wellbore pipe is a carbon steel pipe joint such as drill pipe, casing or liner, the housing is preferably fabricated from carbon steel. This metallurgical match avoids galvanic corrosion at the coupling.

The housing 410 is dimensioned to be strong enough to protect internal electronics. In one aspect, the housing 410 has an outer wall 412 that is about 0.2 inches (0.51 cm) in thickness. A bore 405 is formed within the wall 412. The bore 405 houses the electronics, shown in FIG. 4B as a battery 430 and a power supply wire 435. An example of a battery suitable for the anticipated environment is one or more lithium primary cells.

The electronics of FIG. 4B also include a transceiver 440 and a circuit board 445. The circuit board 445 will preferably include a micro-processor or electronics module that processes acoustic signals. An electro-acoustic transducer 442 is provided to convert acoustical energy to electrical energy (or vice-versa) and is coupled with outer wall 412 on the side attached to the tubular body. The transducer 442 is in electrical communication with at least one sensor 432.

It is noted that in FIG. 4B, the sensor 432 resides within the housing 410 of the communications node 400. However, as noted, the sensor 432 may reside external to the communications node 400, such as above or below the node 400 along the wellbore. In FIG. 4C, a dashed line is provided showing an extended connection between the sensor 432 and the electro-acoustic transducer 442.

The transceiver 440 will receive an acoustic telemetry signal. In one preferred embodiment, the acoustic telemetry data transfer is accomplished using multiple frequency shift keying (MFSK). Any extraneous noise in the signal is moderated by using well-known conventional analog and/or digital signal processing methods. This noise removal and signal enhancement may involve conveying the acoustic signal through a signal conditioning circuit using, for example, a bandpass filter.

The transceiver will also produce acoustic telemetry signals. In one preferred embodiment, an electrical signal is delivered to an electromechanical transducer, such as through a driver circuit. In a preferred embodiment, the transducer is the same electro-acoustic transducer that originally received the MFSK data. The signal generated by the electro-acoustic transducer then passes through the housing 410 to the tubular body (such as production tubing 240), and propagates along the tubular body to other communication nodes. The re-transmitted signal represents the same sensor data originally transmitted by sensor communications node 284. In one aspect, the acoustic signal is generated and received by a magnetostrictive transducer comprising a coil wrapped around a core as the transceiver. In another aspect, the acoustic signal is generated and received by a piezoelectric ceramic transducer. In either case, the electrically encoded data are transformed into a sonic wave that is carried through the wall of the tubular body in the wellbore.

The communications node 400 optionally has a protective outer layer 425. The protective outer layer 425 resides external to the wall 412 and provides an additional thin layer of protection for the electronics. The communications node 400 is also preferably fluid sealed with the housing 410 to protect the internal electronics. Additional protection for the internal electronics is available using an optional potting material.

The communications node 400 also optionally includes a shoe 500. More specifically, the node 400 includes a pair of shoes 500 disposed at opposing ends of the wall 412. Each of the shoes 500 provides a beveled face that helps prevent the node 400 from hanging up on an external tubular body or the surrounding earth formation, as the case may be, during run-in or pull-out. The shoes 500 may have a protective outer layer 422 and an optional cushioning material 424 (shown in FIG. 4A) under the outer layer 422.

Figure 5A:
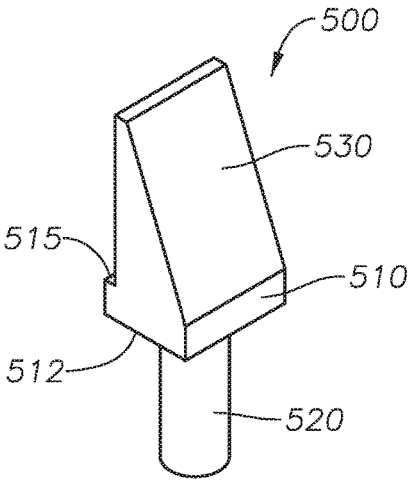
FIGS. 5A and 5B are perspective views of a shoe as may be used on opposing ends of the communications node of FIG. 4A, in one embodiment.
Figure 5B:
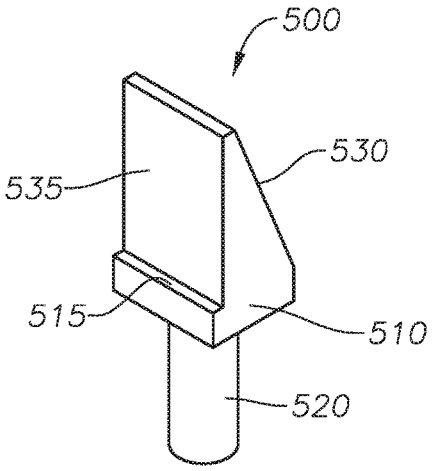

FIGS. 5A and 5B are perspective views of an illustrative shoe 500 as may be used on an end of the communications node 400 of FIG. 4A, in one embodiment. In FIG. 5A, the leading edge or front of the shoe 500 is seen, while in FIG. 5B the back of the shoe 500 is seen.

The shoe 500 first includes a body 510. The body 510 includes a flat under-surface 512 that butts up against opposing ends of the wall 412 of the intermediate communications node 400.

Extending from the under-surface 512 is a stem 520. The illustrative stem 520 is circular in profile. The stem 520 is dimensioned to be received within opposing recesses 414 of the wall 412 of the node 400.

Extending in an opposing direction from the body 510 is a beveled surface 530. As noted, the beveled surface 530 is designed to prevent the communications node 400 from hanging up on an object during run-in into a wellbore.

Behind the beveled surface 530 is a flat (or slightly curved) surface 535. The flat surface 535 is configured to extend along the drill string 160 (or other tubular body) when the communications node 400 is attached along the tubular body. In one aspect, the shoe 500 includes an optional shoulder 515. The shoulder 515 creates a clearance between the flat surface 535 and the tubular body opposite the stem 520.

The shoes 500 are preferably attached to the body 410 of the node 400 by welding. Welding preferably takes place before the nodes are delivered to the well site to avoid the presence of sparks. In another arrangement, the shoes 500 are applied through a glue, or by using a threaded connection with gaskets.

In one arrangement, the communications nodes 400 with the shoes 500 are welded onto an inner or outer surface of the tubular body, such as wall 310 of the pipe joint 300. More specifically, the body 410 of the respective communications nodes 400 are welded onto the wall of the tubular body. In some cases, it may not be feasible or desirable to pre-weld the communications nodes 400 onto pipe joints before delivery to a well site. Therefore, it is desirable to utilize a clamping system that allows a drilling or service company to mechanically connect/disconnect the communications nodes 400 along a tubular body as the tubular body is being run into a wellbore.

Figure 6:
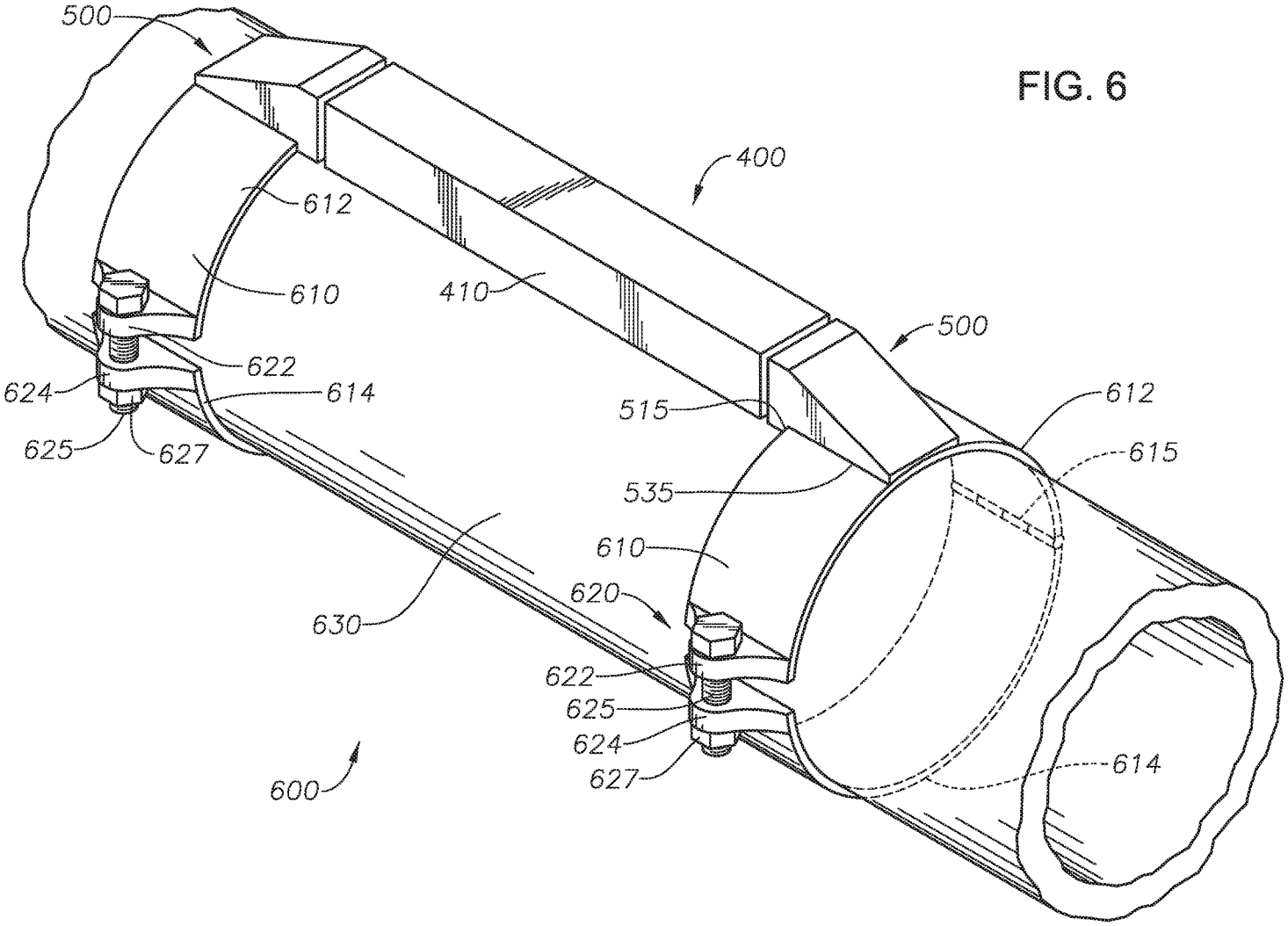
FIG. 6 is a perspective view of a communications node system of the present invention, in one embodiment. The communications node system utilizes a pair of clamps for connecting a communications node onto a tubular body.

FIG. 6 is a perspective view of a communications node system 600 of the present invention, in one embodiment. The communications node system 600 utilizes a pair of clamps 610 for mechanically connecting an intermediate communications node 400 onto a tubular body 630.

The system 600 first includes at least one clamp 610. In the arrangement of FIG. 6, a pair of clamps 610 is used. Each clamp 610 abuts the shoulder 515 of a respective shoe 500. Further, each clamp 610 receives the base 535 of a shoe 500. In this arrangement, the base 535 of each shoe 500 is welded onto an outer surface of the clamp 610. In this way, the clamps 610 and the communications node 400 become an integral tool.

The illustrative clamps 610 of FIG. 6 include two arcuate sections 612, 614. The two sections 612, 614 pivot relative to one another by means of a hinge. Hinges are shown in phantom at 615. In this way, the clamps 610 may be selectively opened and closed.

Each clamp 610 also includes a fastening mechanism 620. The fastening mechanisms 620 may be any means used for mechanically securing a ring onto a tubular body, such as a hook or a threaded connector. In the arrangement of FIG. 6, the fastening mechanism is a threaded bolt 625. The bolt 625 is received through a pair of rings 622, 624. The first ring 622 resides at an end of the first section 612 of the clamp 610, while the second ring 624 resides at an end of the second section 614 of the clamp 610. The threaded bolt 625 may be tightened by using, for example, one or more washers (not shown) and threaded nuts 627.

In operation, a clamp 610 is placed onto the tubular body 630 by pivoting the first 612 and second 614 arcuate sections of the clamp 610 into an open position. The first 612 and second 614 sections are then closed around the tubular body 630, and the bolt 625 is run through the first 622 and second 624 receiving rings. The bolt 625 is then turned relative to the nut 627 in order to tighten the clamp 610 and connected communications node 400 onto the outer surface of the tubular body 630. Where two clamps 610 are used, this process is repeated.

The tubular body 630 may be, for example, a drill string such as the illustrative drill string 160 of FIG. 1. Alternatively, the tubular body 630 may be a string of production tubing such as the tubing 240 of FIG. 2. In any instance, the tubular body 630 is ideally fabricated from a steel material having a thickness which contributes to broadening a mechanical response of the electro-acoustic transducer in the intermediate communications node 400, where the mechanical resonance is at a frequency contained within the frequency band used for telemetry.

In one aspect, the communications node 400 is about 12 to 20 inches (0.30 to 0.51 meters) in length as it resides along the tubular body 630. Specifically, the housing 410 of the communications node may be 8 to 16 inches (0.20 to 0.41 meters) in length, and each opposing shoe 500 may be 2 to 5 inches (0.05 to 0.13 meters) in length. Further, the communications node 400 may be about 1 inch in width and 1 inch in height. The housing 410 of the communications node 400 may have a concave profile that generally matches the radius of the tubular body 630.

A method for transmitting data in a wellbore is also provided herein. The method preferably employs the communications node 400 and the clamping system 600 of FIG. 6.

Figure 7:
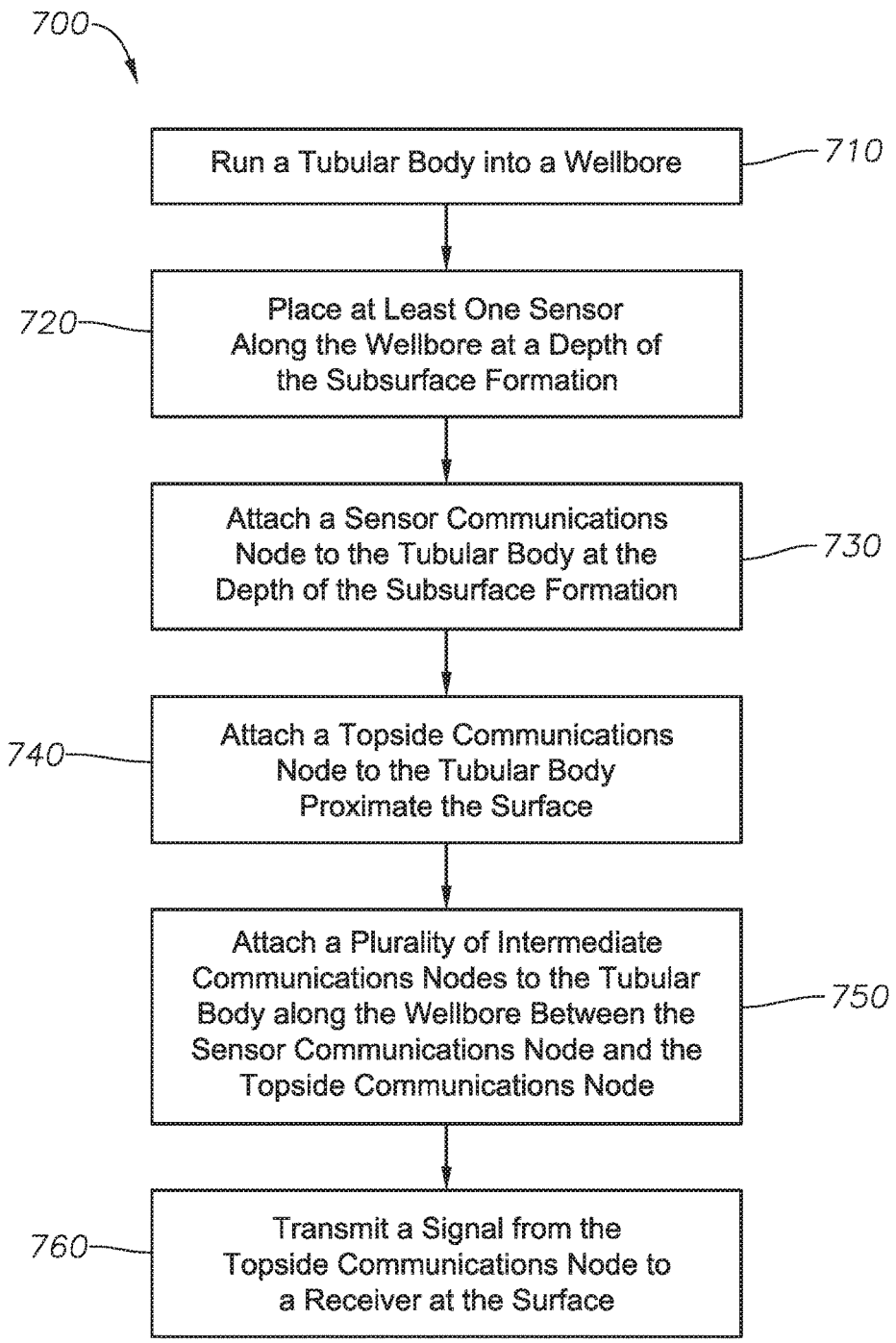
FIG. 7 is a flowchart demonstrating steps of a method for transmitting data in a wellbore in accordance with the present inventions, in one embodiment.

FIG. 7 provides a flow chart for a method 700 of transmitting data in a wellbore. The method 700 uses a plurality of communications nodes situated along a tubular body to accomplish a wireless transmission of data along the wellbore. The wellbore penetrates into a subsurface formation, allowing for the communication of a wellbore condition at the level of the subsurface formation up to the surface.

The method 700 first includes running a tubular body into the wellbore. This is shown at Box 710. The tubular body is formed by connecting a series of pipe joints end-to-end. The pipe joints are fabricated from a steel material that is suitable for conducting an acoustical signal.

The method 700 also includes placing at least one sensor along the wellbore at a depth of the subsurface formation. This is provided at Box 720. Here, the sensor may be a pressure sensor, a temperature sensor, an inclinometer, a logging tool, a resistivity sensor, a vibration sensor, a fluid density sensor, a fluid identification sensor, a fluid flow measurement device (such as a so-called "spinner") or other sensor. The sensor may reside, for example, along a string of drill pipe as part of a rotary steerable drilling system. Alternatively, the sensor may reside along a string of casing within a wellbore. Alternatively still, the sensor may reside along a string of production tubing or a joint of sand screen.

The method 700 further includes attaching a sensor communications node to the tubular body. This is seen at Box 730. The sensor communications node may be placed either inside or outside of a tubular body. The sensor communications node is then placed at the depth of the subsurface formation. The sensor communications node is in communication with the at least one sensor. This is preferably a short wired connection or a connection through a circuit board. The sensor communications node is configured to receive signals from the at least one sensor. The signals represent a subsurface condition such as temperature, pressure, pipe strain, fluid flow or fluid composition, or geology.

Preferably, the at least one sensor resides within the housing for the sensor communications node. The sensor communications node may alternatively be configured to use the electro-acoustic transducer as a sensor.

The method 700 also provides for attaching a topside communications node to the tubular body. This is indicated at Box 740. The topside communications node is attached to the tubular body proximate the surface. In one aspect, the topside communications node is connected to the well head, which for purposes of the present disclosure may be considered part of the tubular body.

The method 700 further comprises attaching a plurality of intermediate communications nodes to the tubular body. This is shown at Box 750. The intermediate communications nodes reside in spaced-apart relation along the tubular body between the sensor communications node and the topside communications node. The intermediate communications nodes are configured to receive and transmit acoustic waves from the sensor communications node to the topside node. Each acoustic signal represents a packet of data comprised of a collection of separate tones.

In one aspect, piezo wafers or other piezoelectric elements are used to receive and transmit acoustic signals. In another aspect, multiple stacks of piezoelectric crystals or magnetostrictive devices are used. Signals are created by applying electrical signals of an appropriate frequency across one or more piezoelectric crystals, causing them to vibrate at a rate corresponding to the frequency of the desired acoustic signal. In another aspect, the transducers are rotated within the housing relative to the external tubular to generate acoustic waves that propagate along the tubular with minimum loss of amplitude or around the tubular with maximum sensitivity to parameters of interest of the cement sheath.

In the method 700, each of the intermediate communications nodes has an independent power source. The independent power source may be, for example, batteries or a fuel cell. In addition, each of the intermediate communications nodes has a transducer. The transducer is preferably an electro-acoustic transducer with an associated transceiver that is designed to receive the acoustic waves and produce acoustic waves.

In one aspect, the data transmitted between the nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. Preferably, the communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node so that if one node fails, it can be bypassed by transmitting data directly between its nearest neighbors above and below. In one example, the tones can be approximately evenly spaced in frequency but the tones may be spaced within a frequency band from about 50 kHz to about 500 kHz. More preferably, the tones are spaced within a frequency band approximately 20 kHz wide centered around 100 kHz. The tones are preferably contiguous.

In one aspect, the tubular body is a drill string. In this instance, each of the intermediate communications nodes is preferably placed along an outer diameter of pipe joints making up the drill string. In another aspect, the tubular body is a casing string. In this instance, each of the intermediate communications nodes is placed along an outer surface of pipe joints making up the casing string. In yet another embodiment, the tubular body is a production string such as tubing. In this instance, each of the intermediate communications nodes may be placed along an outer diameter of pipe joints making up the production string.

In one aspect, the method 700 further includes transmitting a signal from the topside communications node to a receiver. This is shown at Box 760. The topside communications node also comprises an independent power source, meaning that it does not also supply power to any other intermediate or sensor communications node. The independent power source may be either internal to or external to the topside communications node. Further, the topside communications node has an electro-acoustic transducer designed to receive the acoustic waves from one or more of the plurality of intermediate communications nodes, and transmit acoustic waves to the receiver as a new signal. Further, the topside node includes a magnetically activated reed switch or other means to silence radio transmissions from the node without opening the Class I Div 1 housing.

The communication signal between the topside communications node and the receiver may be either a wired electrical signal or a wireless radio transmission. Alternatively, the signal may be an optical signal. In any instance, the signal represents a subsurface condition as transmitted by the sensor in the subsurface formation. The signals are received by the receiver, which has data acquisition capabilities. The receiver may employ either volatile or non-volatile memory. The data may then be analyzed at the surface.

As can be seen, a novel downhole telemetry system is provided, as well as a novel method for the wireless transmission of information using a plurality of data transmission nodes. The re-transmission process that takes place along the nodes not only provides a mechanism to remove signal noise, but also increases the signal amplitude. In the system, the repertoire of frequencies used by the nodes for communication, the amplitude of each frequency, the time duration for which each frequency is transmitted, and the time between signals may be optimized to find a balance between data transmission rate and energy used in data transmission.

In one embodiment, the tubular body is made up of joints of pipe that form a casing string. Some of the joints of pipe and the connected communications nodes may be surrounded by a cement sheath. Acoustic signals may be sent as a collection of tones, or message packets, through the casing string during drilling or during later production operations. The acoustic signals may also be used to interrogate cement properties such as density and porosity.

In one aspect, each communications node 280 will listen for one or more tones of a specific frequency that, individually or collectively, indicate the start of a message packet. This enables an asynchronous network communication.

Figure 8:
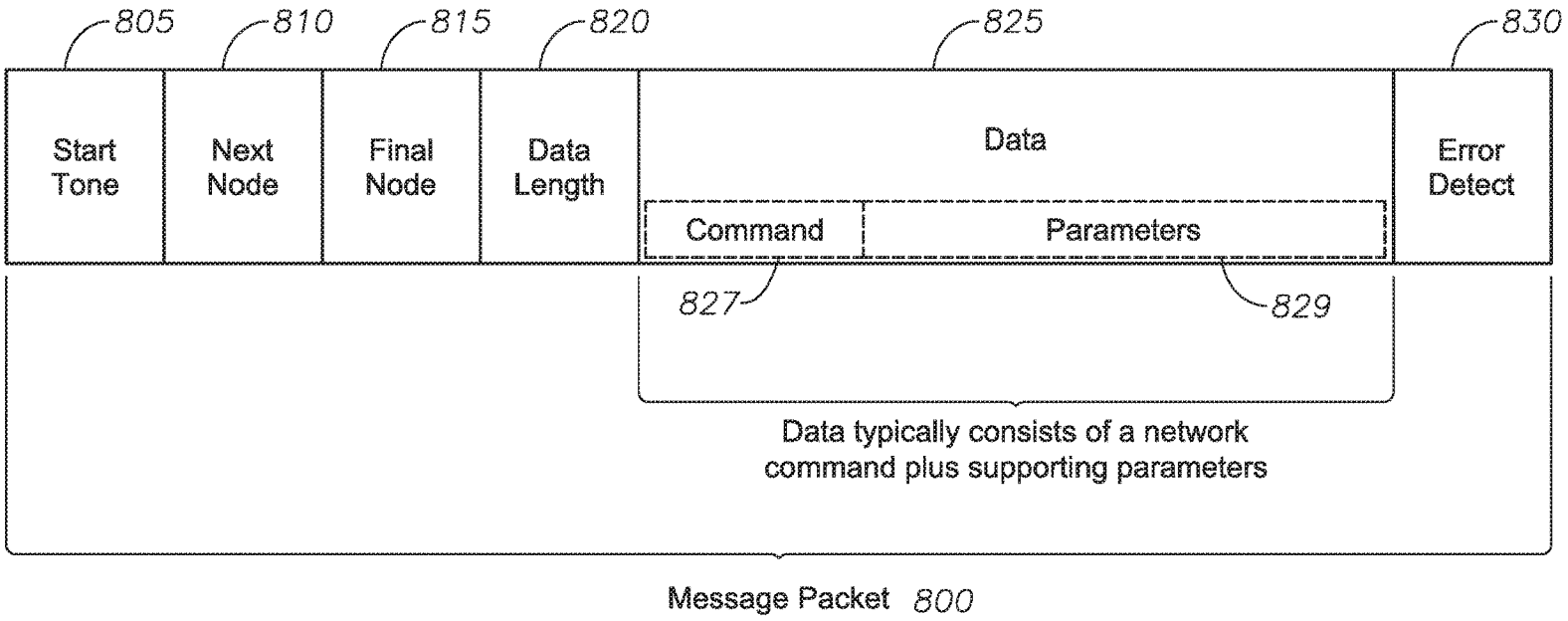
FIG. 8 provides an example of an asynchronous network message packet as may be used for the acoustic signals in the present invention, in one embodiment.

FIG. 8 presents an example of a message packet 800. In this example, the message packet first consists of one or more start tones 805 The start tone(s) 805 is followed by one or more tones 810 identifying a next node to receive the message packet 800. The next tone 810 is followed by one or more tones 815 identifying the final node to receive the message packet 800.

One or more additional tones 820 are provided in FIG. 8 that follow the final tone 815. The tones 820 indicate the length of the data to be included in the message packet 800. The data length tones 820 are then followed by a corresponding number of data tones 825. These tones 825 represent the data portion of the message packet 800. The data portion (tones 825) of the message packet 800 typically contains a command 827 followed by one or more associated related parameters 829.

The message packet 800 finally includes one or more tones 830 used by the receiving node to validate a correct receipt of the message packet 800. This may be done via a checksum calculation, a cyclic redundancy check (CRC), or some other means of error detection.

In operation, a communications node creates and transmits a message packet 800 with the start tone 805. The next node tones 810 identified in the packet 800 receives the message packet 800, replaces the next node tone 810 in the message packet 800 with the identifier for a communications node typically closer to the final node identified in the message packet 800 by final tone 815. The communications node then transmits the changed message packet. This process continues until the communications node receiving the message packet 800 is the final node as identified in the message packet 800. The final node typically acts on the message packet 800 and transmits a reply in the form of a new message packet identifying a different final node.

After sending a message packet 800, the transmitting node preferably listens for the receiving node to transmit the new message packet. The new message packet typically represents a modified version of the original message packet, or a reply to the original message packet. Note that the new message packet is not necessarily addressed to the node that originated the message. If the transmitting node does not hear the receiving node transmit a new message packet, it resends the original message packet to the receiving node. This protocol facilitates detection of a lost message packet (a message packet transmitted but not received) and increases the likelihood of successful transmission of a message packet to a receiving node.

In order to change communication specifications such as tonal frequencies, tone transmission duration, waiting time between tones, and tonal amplitude, a "bi-lingual" command may be sent. This command enables pairs of nodes to temporarily transmit and receive using both the original communication protocol and an adjusted communication protocol. If only a subset of nodes is to be changed, this bi-lingual capability must be maintained at each interface. This procedure requires the simultaneous use of two sets of communication specifications.

In one aspect, each communications node will alternate between being awake (an awake state) and being asleep (a sleep state). In the awake state, a node is able to communicate; in the sleep state, the node is unable to transmit, although it is able to collect data. In the sleep state, the node is periodically able to receive a wakeup packet causing it to return to the awake state. In the sleep state, the node is also periodically able to receive a wait stub, causing it to listen for an additional amount of time for another wait stub or for a wakeup packet. The purpose of placing the node into sleep state is to place the electronics in a state of low power consumption. This multi-state capability, in turn, extends battery life.

In one embodiment, each communications node will operate in one of two states of operation: In the first state, called the sleep state, the node will sleep for a first period of time (typically a few minutes) and then wake up for a second period of time (typically a few seconds) to listen for incoming wait stubs or wakeup packets. If no wait stubs or wakeup packet is received, the node will return to its sleep state. This cycle will be repeated during the sleep state. In the second state, called the awake state, the node is always awake. A node will change state if it receives a message packet (while awake) instructing it to change state.

Figure 9:
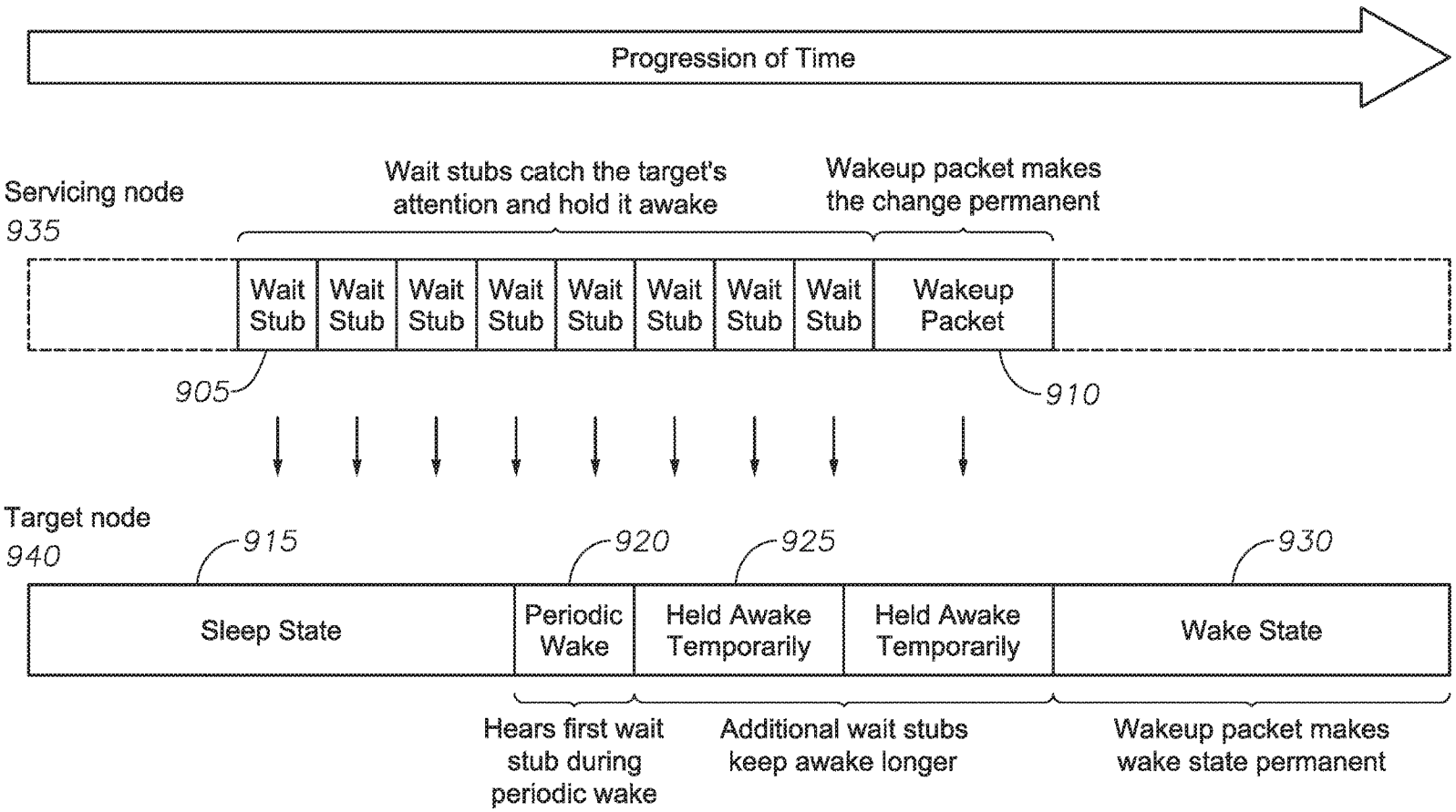
FIG. 9 is an example of a transition of a communications node from a sleep state to a wake state using a series of wait stubs and a wakeup packet.

Preferentially, the communication protocol defines a wait stub which short in duration compared to typical message packets that may be sent. FIG. 9 is an example of a sleep-to-wake transition using wait stubs 905 and a wakeup packet 910. In FIG. 9, two nodes are shown as being in acoustic communication. The two nodes represent a servicing node 935 and a target node 940. The target node 940 is initially in a sleep state 915 until being awoken into its awake state 930.

It can be seen that the servicing node 935 has transmitted a series of wake stubs 905 to the target node 940. The wait stubs 905 cause the target node 940, which is periodically awake 920 while in its sleep state 915, to remain awake temporarily for an additional period of time 925 (typically 15 seconds). During the temporarily awake times 925, additional wait stubs 905 may be received, causing the target node 940 to stay awake for still additional periods of time 925. A wakeup packet 910 may then be sent from the servicing node 935, instructing the target node 940 to switch to its awake state 930. In this state, the target node 940 will remain awake.

It is noted that the use of the wait stubs 905 to produce additional wake times 925 wherein a full length wakeup packet 910 may be received enables the periodic awake time while in sleep state 920 to be shorter. This, in turn, reduces the power consumption as compared to a protocol where the periodic awake time 920 in sleep state is long enough to receive a full wakeup packet 910. The servicing node 935 may transmit wait stubs 905 to the intended target node 940 at regular intervals to cause the target node 940 to awaken sooner and more reliably than would have been otherwise possible. Likewise, a sleeping target node 940 does not need to send transmissions to indicate when it is able to receive a wakeup packet 910, thereby saving the energy otherwise needed to transmit such transmissions.

In one aspect, each communications node is optionally configured to transmit a message packet comprising a collection 800 of tones used in acoustic telemetry, such as 16 tones, and determine the amplitudes and reverberation times of each tone when receiving such a packet 800. The node can preferably use this information to minimize energy usage and maximize data rate while maintaining reliable communication. In one embodiment, a packet consisting of all of the tones of interest is sent directly (with no relay nodes) from a transmitter node to a receiver node. The receiving node and the transmitting node together form a pair of nodes.

The receiving node detects the received amplitude and reverberation time for each tone in the packet. The receiving node then sends the same data back to the transmitting node. The transmitting node adjusts its transmit energy so that the weakest tone will be received at the weakest signal amplitude for which communication is still robust. The transmitting node may further reduce the waiting time between tones to the smallest time required for the reverberation to substantially subside. The transmitting node may also instruct the receiving node that it has made these changes in the communication protocol. In some cases, the results of such an amplitude assessment may conclude that tonal amplitudes at one band edge are weaker than all the other tones. Such a finding may suggest a manual or automated shift in the frequency band for the tonal alphabet. The aforementioned bi-lingual capability can facilitate a frequency band shift.

In one embodiment, each communications node has a query capability so that only logged data which meet certain criteria is retrieved, for example, retrieving only the measurements from a particular sensor such as a thermistor or strain gauge or acoustic transducer, or retrieving only measurements which were collected within a particular time window, or retrieving only every Nth measurement where N is an integer greater than 1. This can reduce the necessary volume of data transmission from a servicing node, which can reduce the node's energy consumption and extend the node's effective life.

In another aspect, each node is configured to automatically discharge its batteries when certain criteria are met. In this way, consuming reactants in the battery that might otherwise create a risk to the node electronics or node housing by remaining unreacted within the battery for an extended period of time are removed. For example, a node may be configured to discharge lithium primary batteries on a certain date and time, thereby reacting the remaining lithium metal within the batteries and transforming it into more chemically stable compounds. The criteria for discharging the batteries include reaching a certain date and time, the passing of a certain period of time since the last communication with the node, or observing a certain sensor measurement in a certain range, such as a temperature that exceeds some threshold, or observing a combination of sensor measurements that indicate that external or internal conditions have occurred that make it prudent to discharge the batteries.

Various forms of error correction may also be applied in the acoustic telecommunications network. An example of one form is presented here to account for the irregularity of the frequency response of acoustic transducers across the band used for telemetry. In this respect, some tones are produced and received more weakly than others. Successful telemetry requires that even the weakest tone be audible amidst the ambient noise. It is typically necessary to increase the transmit signal amplitudes of all tones until the very weakest tone becomes audible. As an alternative, each communications node may employ a sequence of redundant tones, with at least two of the tones differing in frequency, to represent each data value. By using a sequence of two or more redundant tones for each data value, the system can still communicate if one or more of the redundant tones happens to be particularly weak. The node preferentially combines detection statistics for each group of redundant tones to enable successful communication even in cases for which all the redundant tones in a group are particularly weak. Both redundancy and pooling of detection statistics make the communication more reliable.

In one embodiment, the electro-acoustic telemetry network of the present invention uses a sliding alphabet as a method of reducing adverse impact of reverberation during transmission and reception of message packets 800. One way such adverse impact could occur involves the transmission of two successive tones that happen to be identical in frequency. Such a circumstance may lead to ambiguity for the receiving node 940 in distinguishing between a distinct second tone as opposed to reverberant noise from the first tone.

Figure 10:
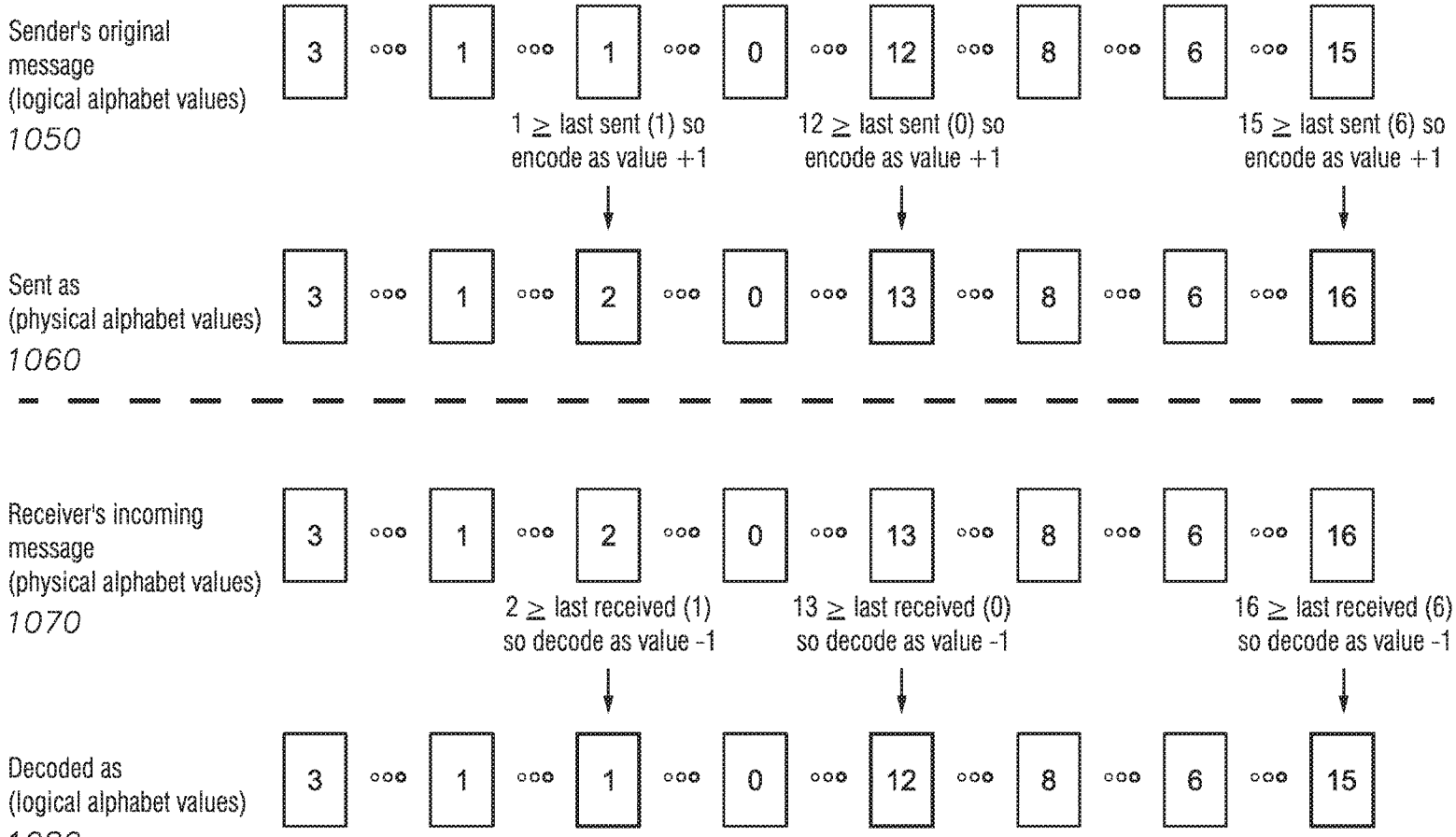
FIG. 10 shows an example of a sliding alphabet algorithm as may be used for processing acoustic signals in the present invention, in one embodiment. The algorithm is designed to eliminate the occurrence of two of the same tones sent consecutively (given a set of defined tones associated with defined frequencies) during a MFSK communication.

FIG. 10 presents an example of the use of a sliding alphabet in an multi-frequency shift keying (MFSK) process. In this figure, a message packet is shown in four forms. The first form is shown at 1050; this is the sending node's original acoustic message. The second form is shown at 1060; this is the sending node's modified message. The third form is shown at 1070; this is the acoustic message received by the target node. Finally, the fourth form is shown at 1080; this is the message as deconstructed by the target node.

In the example of FIG. 10, messages are acoustic signals sent by a transceiver along a tubular body that represent a logical alphabet. The logical alphabet consists of integer values between, for example, 0 and 15, inclusive. This means that the message packets consist of a sequence of logical alphabet values, representing tones. In practice, each communications node in the network is configured to associate the same set of distinct frequencies with the same physical alphabet consisting of consecutive integer values, beginning with "0." This will allow for at least one excess value of the physical alphabet.

To transmit a message packet, a transmitting node iterates through the message packet's constituent logical alphabet values 1050 from beginning to end of the message packet. In each case, the transmitting node either transmits a physical alphabet value equal to the logical alphabet value when the logical alphabet value is less than the previously transmitted physical alphabet value, or transmits a physical alphabet value equal to the logical alphabet value +1 when the logical alphabet value is equal to or greater than the previously transmitted physical alphabet value 1060. This technique is one example of a sliding alphabet algorithm.

The receiving node deconstructs the received message packet by combining the received physical alphabet values 1070 from beginning to end of the message packet, in each case assigning a logical alphabet value equal to the physical alphabet value when the physical alphabet value is less than the previous physical alphabet value, or assigning a logical alphabet value equal to the physical alphabet value −1 when the physical alphabet value is equal to or greater than the previous physical alphabet value 1080. This deconstruction technique is one example of a complement to the sliding alphabet algorithm.

It is noted that a sliding alphabet incorporates both an algorithm and a complement to the algorithm. In essence, the algorithm encodes the message packet while the complement to the algorithm decodes a message packet encoded by that specific algorithm. Thus, the algorithm is an encoder, while the complement to the algorithm is a decoder.

In one embodiment, the method for modulating acoustic waves comprises the steps of:

generating a first set of tones from a first electro-acoustic transceiver, with each tone being associated with a defined frequency, and with each tone being associated with a logical alphabet value;

reviewing the first set of tones to determine if two consecutive tones have the same logical alphabet value;

if two consecutive tones do have the same logical alphabet value, modifying the first set of tones to provide that no two same tones are sent consecutively, thereby generating a modified first set of tones;

transmitting the modified first set of tones from the first electro-acoustic transceiver;

receiving the modified first set of tones from the first electro-acoustic transceiver at a second electro-acoustic transceiver as a message packet;

reviewing the modified first set of tones; and deconstructing the modified first set of tones back to its original first set of tones.

In one aspect, the modifying step comprises determining whether a tone in the first set of tones is equal to or greater than an immediately preceding tone in the first set of tones and, if a tone in the first set of tones is equal to or greater than an immediately preceding tone in the first set of tones, increasing the logical alphabet value by a defined alphabet value. In this instance, the deconstruction step comprises determining whether a tone in the modified first set of tones is greater than an immediately preceding tone in the modified first set of tones and, if a tone in the modified first set of tones is equal to or greater than an immediately preceding tone in the modified first set of tones, decreasing the logical alphabet value by the defined alphabet value. Preferably, the defined alphabet value is a next higher frequency. However, the defined alphabet value may be any sum (such as x+2), any difference (such as x−2), or product (such as x3), or any algebraic formula (such as x2−1).

In another aspect, the modifying step comprises determining whether a tone in the first set of tones is equal to or less than an immediately preceding tone in the first set of tones and, if a tone in the first set of tones is equal to or less than an immediately preceding tone in the first set of tones, decreasing the logical alphabet value by a defined alphabet value. In this instance, the deconstruction step comprises determining whether a tone in the modified first set of tones is equal to or less than an immediately preceding tone in the modified first set of tones and, if a tone in the modified first set of tones is equal to or less than an immediately preceding tone in the modified first set of tones, increasing the logical alphabet value by the defined alphabet value. Preferably, the defined alphabet value is a next lower frequency.

In either instance, each of the first and second electro-acoustic transceivers may reside either in a wellbore or along a pipeline as part of a telemetry system.

While it will be apparent that the inventions herein described are well calculated to achieve the benefits and advantages set forth above, it will be appreciated that the inventions are susceptible to modification, variation and change without departing from the spirit thereof.

What is claimed is:

1. A method of transmitting data in a wellbore, comprising:

running a tubular body into the wellbore, the wellbore penetrating into a subsurface formation and the tubular body being comprised of pipe joints;

placing at least one sensor along the wellbore at a depth of the subsurface formation;

attaching a sensor communications node to a wall of the tubular body proximate the depth of the subsurface formation, the sensor communications node being in communication with the at least one sensor and configured to receive signals from the at least one sensor, the signals representing a subsurface condition;

providing a topside communications node proximate a surface of the wellbore; and attaching a plurality of intermediate communications nodes to a wall of the tubular body in spaced-apart relation, the intermediate communications nodes configured to transmit acoustic waves from the sensor communications node to the topside communications node in node-to-node arrangement;

wherein each of the intermediate communications nodes comprises:

a sealed housing;

an independent power source residing within the housing;

an electro-acoustic transducer and associated transceiver also residing within the housing designed to:

generate a first set of tones from a first electro-acoustic transceiver, each tone being associated with a defined frequency, and each tone being associated with a logical alphabet value;

review the first set of tones to determine if two consecutive tones have the same logical alphabet value;

if two consecutive tones do have the same logical alphabet value, modifying the first set of tones to provide that no two same tones are sent consecutively, thereby generating a modified first set of tones;

transmit the modified first set of tones from the first electro-acoustic transceiver;

receive the modified first set of tones from the first electro-acoustic transceiver at a second electro-acoustic transceiver as a message packet; reviewing the modified first set of tones; and deconstructing the modified first set of tones back to its original first set of tones; and at least one clamp for radially attaching the communications node onto an outer surface of the tubular body.

2. The method of claim 1, wherein: the modifying step comprises determining whether a tone in the first set of tones is equal to or greater than an immediately preceding tone in the first set of tones and, if a tone in the first set of tones is equal to or greater than an immediately preceding tone in the first set of tones, increasing the logical alphabet value by a defined alphabet value; and the deconstruction step comprises determining whether a tone in the modified first set of tones is greater than an immediately preceding tone in the modified first set of tones and, if a tone in the modified first set of tones is equal to or greater than an immediately preceding tone in the modified first set of tones, decreasing the logical alphabet value by the defined alphabet value.

3. The method of claim 2, wherein the defined alphabet value is a next higher frequency.

4. The method of claim 1, wherein: the modifying step comprises determining whether a tone in the first set of tones is equal to or less than an immediately preceding tone in the first set of tones and, if a tone in the first set of tones is equal to or less than an immediately preceding tone in the first set of tones, decreasing the logical alphabet value by a defined alphabet value; and the deconstruction step comprises determining whether a tone in the modified first set of tones is equal to or less than an immediately preceding tone in the modified first set of tones and, if a tone in the modified first set of tones is equal to or less than an immediately preceding tone in the modified first set of tones, increasing the logical alphabet value by the defined alphabet value.

5. The method of claim 4, wherein the defined alphabet value is a next lower frequency.

6. The method of claim 1, wherein each of the first and second electro-acoustic transceivers resides either in a wellbore or along a pipeline as part of a telemetry system.

* * * * *